US008781363B2

(12) United States Patent
Ishikuro

(10) Patent No.: US 8,781,363 B2
(45) Date of Patent: Jul. 15, 2014

(54) MEDIUM CARRYING UNIT AND IMAGE FORMING APPARATUS USING THE MEDIUM CARRYING UNIT

(75) Inventor: Takemasa Ishikuro, Tokyo (JP)

(73) Assignee: Oki Data Corporation, Tokyo (JP)

( * ) Notice: Subject to any disclaimer, the term of this patent is extended or adjusted under 35 U.S.C. 154(b) by 229 days.

(21) Appl. No.: 13/400,221

(22) Filed: Feb. 20, 2012

(65) Prior Publication Data

US 2012/0230723 A1 Sep. 13, 2012

(30) Foreign Application Priority Data

Mar. 7, 2011 (JP) ..... 2011-049192

(51) Int. Cl.
*G03G 15/08* (2006.01)
*G03G 21/00* (2006.01)

(52) U.S. Cl.
USPC ..... 399/121; 399/124

(58) Field of Classification Search
USPC ..... 399/110, 121, 124, 401, 402
IPC ..... G03G 21/168,21/1695, 21/1623, 21/1638, G03G 2215/0409, 2221/1642, 2221/1672, G03G 2221/1675
See application file for complete search history.

(56) References Cited

U.S. PATENT DOCUMENTS

| | | | | |
|---|---|---|---|---|
| 6,522,848 | B2 * | 2/2003 | Wakana | 399/121 |
| 6,941,093 | B2 * | 9/2005 | Park et al. | 399/116 |
| 7,269,378 | B2 * | 9/2007 | Baek et al. | 399/121 |
| 7,509,073 | B2 * | 3/2009 | Katoh et al. | 399/121 |
| 7,751,750 | B2 * | 7/2010 | Shoji | 399/121 |
| 8,175,492 | B2 * | 5/2012 | Kamimura | 399/111 |

FOREIGN PATENT DOCUMENTS

| | | | | |
|---|---|---|---|---|
| JP | 11-093940 | A | | 4/1999 |
| JP | 2001-121783 | A | | 5/2001 |
| JP | 2006084959 | A | * | 3/2006 |
| JP | 2006085027 | A | * | 3/2006 |
| JP | 2006106628 | A | * | 4/2006 |
| JP | A-2007-101728 | | | 4/2007 |
| JP | 2009-236995 | A | | 10/2009 |
| JP | 2010-107607 | A | | 5/2010 |
| JP | 2010204250 | A | * | 9/2010 |

* cited by examiner

*Primary Examiner* — Robert Beatty

(74) *Attorney, Agent, or Firm* — Muncy, Geissler, Olds & Lowe, P.C.

(57) ABSTRACT

A medium carrying unit to be installed in an image forming apparatus includes a first carrying path through which a medium is carried, a handle member positioned above or around the first carrying path and including a part to be gripped by a user in a state that allows the handle member to project above a carrying surface of the first carrying path, an accommodation area that is defined around the handle member and that accommodates the handle member in a state that allows the handle member to be freely inserted and removed so that the handle member hides below the carrying surface of the first carrying path, and a push-out mechanism that pushes out the handle member from an interior of the accommodation area when the medium carrying unit is removed from the image forming apparatus.

21 Claims, 25 Drawing Sheets

MEDIUM CARRYING UNIT AND IMAGE FORMING APPARATUS USING THE MEDIUM CARRYING UNIT

CROSS REFERENCE TO RELATED APPLICATION

The present application is related to, claims priority from and incorporates by reference Japanese Patent Application No. 2011-049192, filed on Mar. 7, 2011.

TECHNICAL FIELD

The present application relates to a medium carrying unit which carries a medium for printing such as sheets of paper, and in particular relates to a medium carrying unit which includes a handle member that enables the medium carrying unit to be removed from an image forming apparatus, that does not prevent miniaturization of the image forming apparatus, and that is visible and easy to grip. In addition, the present application relates to an image forming apparatus using the medium carrying unit.

BACKGROUND

Conventionally, image forming apparatuses, such as page printers, facsimile machines, photocopy machines, MFPs and the like that form an image through an electrographic process have a configuration wherein if a jam occurs to a medium being carried while printing, the user opens a cover provided on the upper or front surface of the device and removes the jammed medium. Here, "MFP" is the abbreviation of a multifunction printer, which is a printer with additional functions of a facsimile machine, a scanner, a photocopy machine and the like. In addition, "printing" means an operation of forming an image on a medium.

Among the image forming apparatuses (especially image forming apparatuses having a configuration to perform double-sided printing by inverting the medium), there are devices having a configuration where a medium carrying unit that carries a medium is freely detachable. Such medium carrying unit has a handle member that is gripped by the user to enable the medium carrying unit to be easily removed from the image forming apparatus (see JP Laid-Open Patent Application No. 2007-101728, for example).

For example, JP Laid-Open Patent Application No. 2007-101728 discloses a transferring unit as the medium carrying unit. Here, "transferring unit" is a unit that transfers a developer image formed on the surface of a photosensitive drum provided inside an image forming apparatus onto a medium. The transferring unit includes a handle member provided to enable the medium carrying unit to be easily removed from the image forming apparatus. Moreover, the handle member projects from the casing of the transferring unit for easier grip and higher visibility.

However, in the medium carrying unit (hereafter called "conventional medium carrying unit") disclosed in JP Laid-Open Patent Application No. 2007-101728, the handle member is provided to project from the casing of the medium carrying unit for higher visibility. Moreover, in the conventional medium carrying unit, the handle member needs to be provided in a manner that the handle unit does not touch the image forming unit installed above the medium carrying unit. For that reason there is a problem that the conventional medium carrying unit prevents miniaturization of the image forming apparatus.

The present application is made for solving the above-mentioned problem, and has an object to provide a medium carrying unit which includes a handle member for removing the medium carrying unit from an image forming apparatus and does not prevent miniaturization of the image forming apparatus while maintaining visibility and easy gripping of the handle member, and an image forming apparatus whose miniaturization is realized by using the medium carrying unit.

SUMMARY

In order to achieve the object, the first invention is a medium carrying unit to be installed in an image forming apparatus, the unit including a first carrying path through which a medium is carried, a handle member positioned above or around the first carrying path and including a part to be gripped by a user in a state that allows the handle member to project above a carrying surface of the first carrying path, an accommodation area that is defined around the handle member and that accommodates the handle member in a state that allows the handle member to be freely inserted and removed so that the handle member hides below the carrying surface of the first carrying path, and a push-out mechanism that pushes out the handle member from an interior of the accommodation area when the medium carrying unit is removed from the image forming apparatus.

The medium carrying unit accommodates the handle member inside the accommodation area in a state where the handle member can be freely inserted and removed, such that the handle member hides below the carrying surface of the carrying path. In addition, in the medium carrying unit, a push-out mechanism automatically pushes the handle member outwardly from the interior of the accommodation area when the medium carrying unit is removed from the image forming apparatus. Therefore, the medium carrying unit includes the handle member for removing the medium carrying unit from the image forming apparatus and has a configuration that maintains the visibility and easy gripping of the handle member while enabling miniaturization of the image forming unit.

The second invention is an image forming apparatus in which a medium carrying unit that carries a medium for printing is installed in a freely detachable manner. The image forming apparatus includes the medium carrying unit discussed above, and a main body side projection part that contacts the handle member of the medium carrying unit when the medium carrying unit is removed from the image forming apparatus.

This image forming apparatus uses the medium carrying unit according to the first aspect of the present application. The medium carrying unit accommodates the handle member inside the accommodation area in a state where the handle member can be freely inserted and removed, such that the handle member hides below the carrying surface of the carrying path. In addition, in the medium carrying unit, the push-out mechanism automatically pushes the handle member outwardly from the interior of the accommodation area when the medium carrying unit is removed from the image forming apparatus. Therefore, the medium carrying unit includes the handle member for removing the medium carrying unit from the image forming apparatus and has a configuration that maintains the visibility and easy gripping of the handle member while still enabling miniaturization of the image forming unit. As a result, the image forming apparatus realizes the miniaturization while maintaining the visibility and easy gripping of the handle member.

A first aspect of the present application provides a medium carrying unit which includes a handle member for removing the medium carrying unit from an image forming apparatus and which enables miniaturization of the image forming apparatus while maintaining visibility and easy gripping of the handle member. In addition, a second aspect of the present application provides an image forming apparatus which uses the medium carrying unit of the present application.

In another view, a medium carrying unit to be installed in an image forming apparatus of the present invention includes a housing including a first side, a second side that opposes the first side and a side surface between the first and second sides, the first and second sides defining first and second medium carrying paths, respectively, a post that is provided adjacent to the first side and that engages with a positioning part of the image forming apparatus, the post being a unit fulcrum about which the medium carrying unit rotates, a handle member that has a handle post about which the handle member rotates, that is provided on the side surface, and that includes a handle side projection part that engages with a main body side projection part provided on the image forming apparatus when the medium carrying unit is installed, the handle side projection part being positioned between the main body side projection part and the second side, and a biasing part that is provided adjacent to the second side that pushes the medium carrying unit up causing the engagement between the handle side projection part and the main body side projection part to be automatically released when the medium carrying unit is removed from the image forming apparatus.

DETAILED DESCRIPTION OF EMBODIMENTS

Figure 1A:
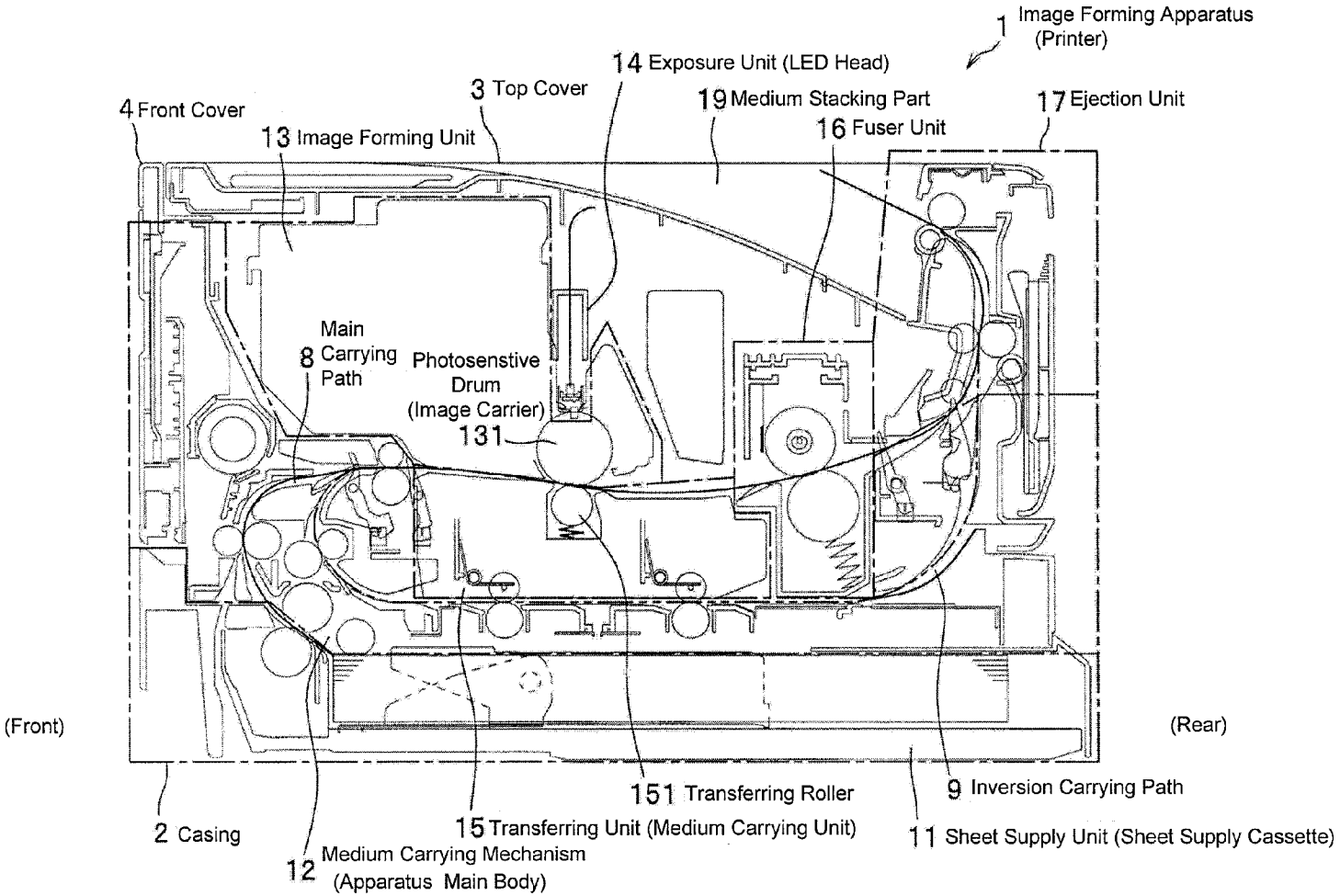
FIG. 1A is a first figure showing a configuration of a mechanical system of an image forming apparatus of a first embodiment.

Below, embodiments of the present application (hereafter, called "the present embodiments") are explained in detail referring to drawings. Here, the drawings only outline the present embodiments to an extent that the embodiments are sufficiently understood. Therefore, the present embodiments are not limited to the examples shown in the drawings. In addition, in the drawings, like symbols are assigned to common or similar components, and duplicate explanations are omitted.

First Embodiment

<Configuration of a Mechanical System of an Image Forming Apparatus>

Figure 1B:
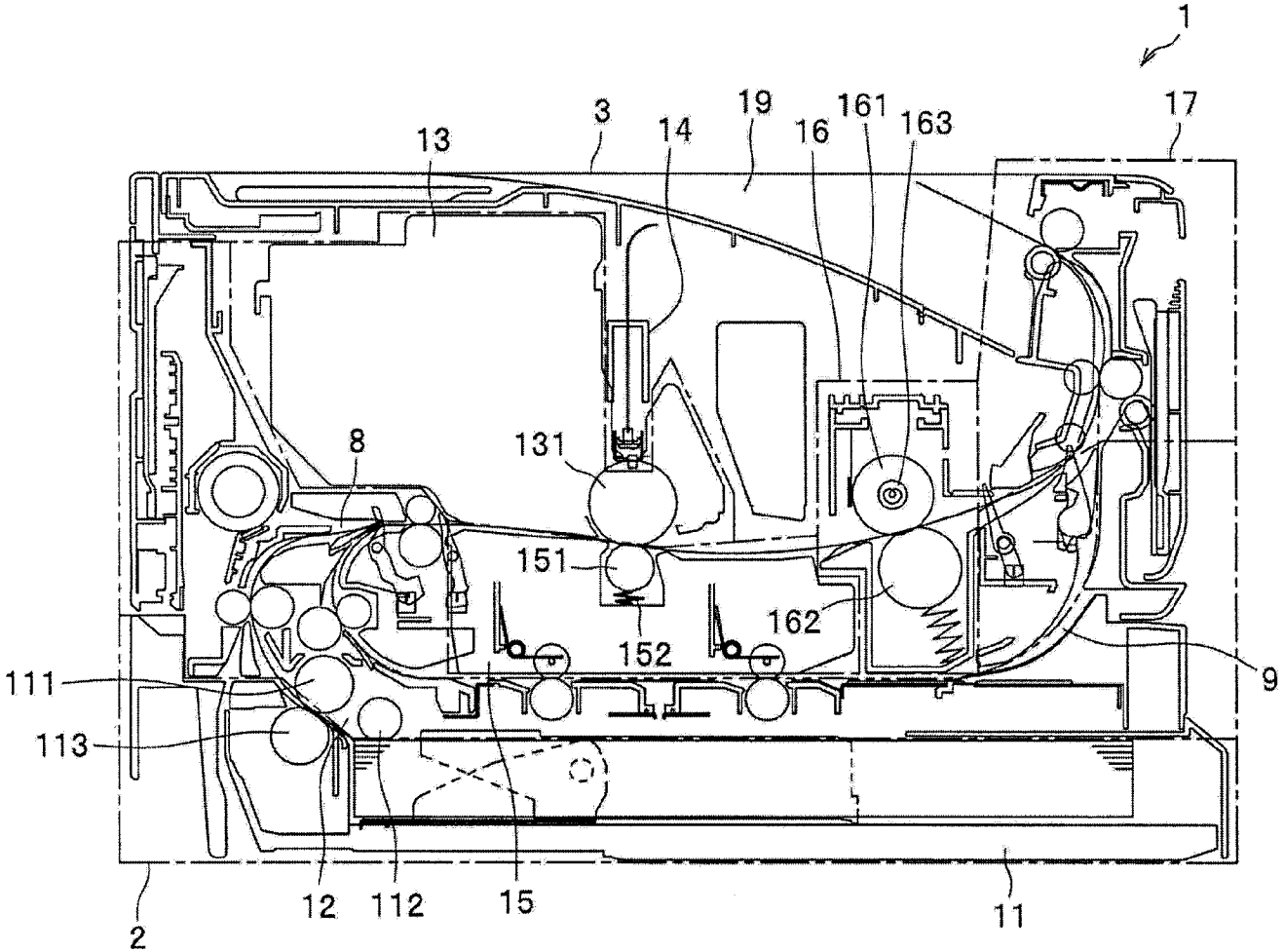
FIG. 1B is a second figure showing the configuration of the mechanical system of the image forming apparatus of the first embodiment.
Figure 1C:
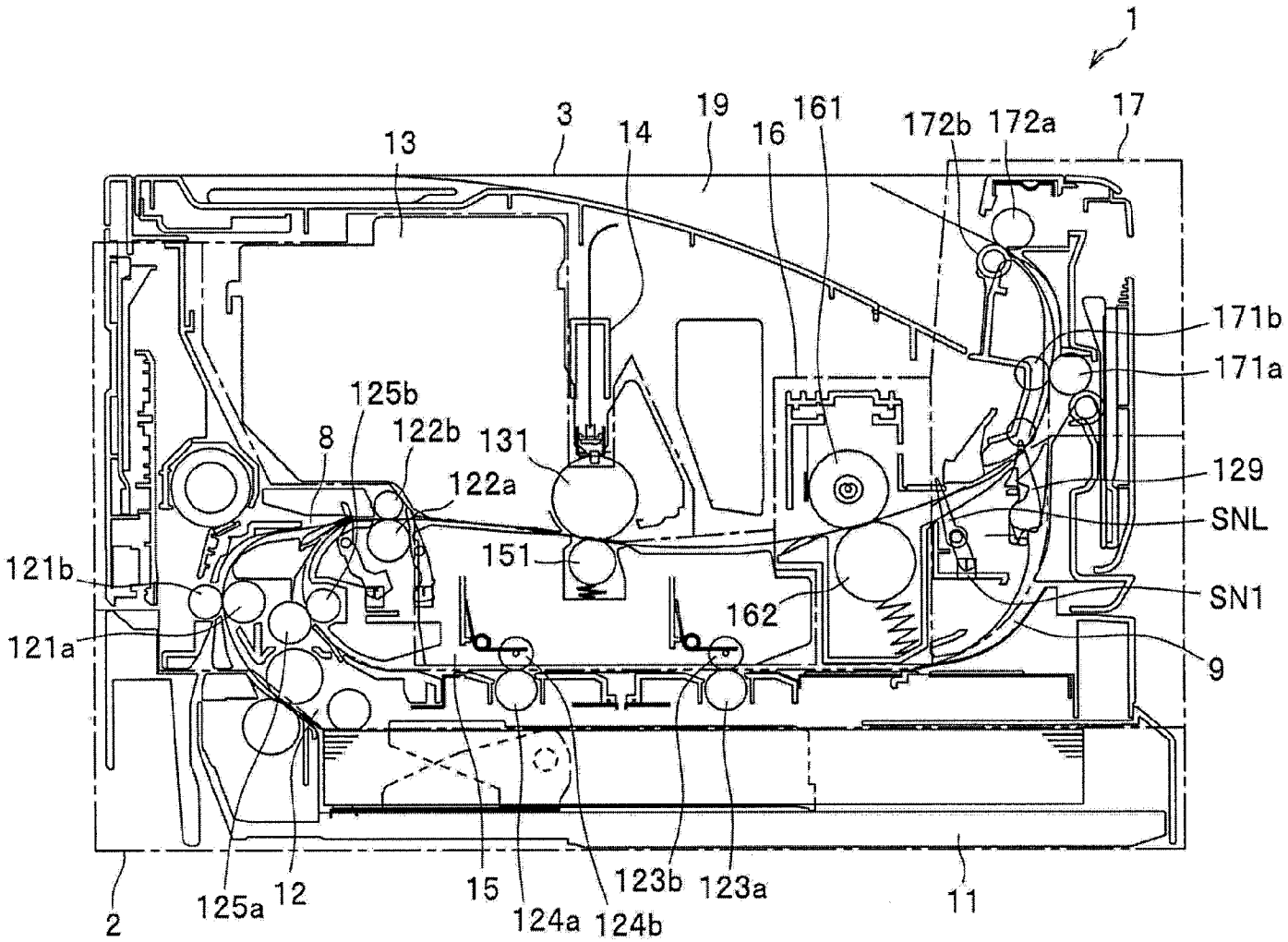
FIG. 1C is a third figure showing the configuration of the mechanical system of the image forming apparatus of the first embodiment.

Below, the configuration of a mechanical system of an image forming apparatus of the first embodiment is explained referring to FIGS. 1A-1C. FIGS. 1A-1C each show the configuration of the mechanical system of the image forming apparatus of the first embodiment. FIGS. 1A-1C each outline the configuration of a side cross-section of an image forming apparatus 1 of the first embodiment.

The image forming apparatus 1 is a device which forms an image through an electrographic process, such as a page printer, a facsimile machine, and an MFP. Here, explanations are given assuming a case where the image forming apparatus 1 is configured as a light emitting diode (LED) type electrographic printer. Hereafter, the image forming apparatus 1 is called a "printer 1". In addition, here, explanations are given assuming that the printer 1 has a configuration which allows double-sided printing by inverting a medium such as a sheet of paper and the like for printing. Moreover, the inversion of the medium means to flip over the top surface and the back surface of the sheet. Hereafter, a carrying path used mainly for printing is called "main carrying path 8", and a carrying path used for inverting the medium is called "inversion carrying path 9". In addition, in the embodiment, the main carrying path is provided on the top surface (first side) of the later-discussed medium carrying unit 15, and the inversion carrying path 9 is provided on a bottom surface (second side) of the medium carrying unit 15. Here, terms "upstream" and "downstream" explained below are based on the carrying direction of the medium.

The printer 1 uses a medium carrying unit 15 of this the first embodiment as a mechanism for carrying the medium. Here, explanations are given assuming a case where the medium carrying unit 15 is configured as a transfer unit which transfers a developer image formed on the surface of an imagine carrier onto the medium. Hereafter, the medium carrying unit 15 is called a "transferring unit 15".

As shown in FIGS. 1A-1C, the printer 1 includes a configuration which has a sheet supply unit 11, a medium carrying mechanism 12, an image forming unit 13, an exposure unit 14, a transferring unit 15, a fuser unit 16, and an ejection unit 17 inside a space formed by a casing 2 in which various components are accommodated, a top cover 3 which covers a upper surface of the casing 2, and a front cover 4 which covers a front surface of the casing 2.

In the example shown in FIGS. 1A-1C, the printer 1 includes the main carrying path 8 provided to curve in an inverted "S" shape so as to connect between the sheet supply unit 11 and a medium stacking part 19 installed on the top cover 3, and further the inversion carrying path 9 provided to curve in a "U" shape so as to branch from the main carrying path 8 and merge again into the main carrying path 8. Then, the medium carrying mechanism 12 has a main section provided along a lower side of the inversion carrying path 9 and further a part provided along the inner circumference of the curved portion between the inversion carrying path 9 and the main carrying path 8. In addition, the image forming unit 13 and the exposure unit 14 are provided on an approximately flat surface of the main carrying path 8. In addition, the transferring unit 15 is provided beneath the approximately flat surface of the main carrying path 8 so as to oppose the image forming unit 13 via the main carrying path 8. Moreover, the fuser unit 16 and the ejection unit 17 are provided in the downstream side of the transferring unit 15 so that the main carrying path 8 passes through the fuser unit 16 and the ejection unit 17. Here, the inversion carrying path 9 is provided in a manner to branch from the main carrying path 8 in the downstream side of the fuser unit 16, to pass below the fuser unit 16 and the transferring unit 15, and to merge again into the main carrying path 8 in the upstream side of the transferring unit 15.

The sheet supply unit 11 is a unit which supplies a medium to the transferring unit 15. The sheet supply unit 11 is configured as a sheet supply cassette which contains a medium inside and which is freely installed to the printer 1. The sheet supply unit 11 has therein a sheet receiver (not shown) and a push-up spring (not shown). In addition, as shown in FIG. 1B, the sheet supply unit 11 has a sheet supply subroller 112 (see FIG. 1B) of the medium carrying mechanism 12 installed above it. The sheet supply unit 11 has a medium stacked on the sheet receiver (not shown), and further has the push-up spring pushing up the sheet receiver to press the medium stacked on the sheet receiver against the sheet supply subroller 112 of the medium carrying mechanism 12

The medium carrying mechanism 12 is a mechanism to carry the medium. As shown in FIG. 1B, the medium carrying mechanism 12 has a sheet supply roller 111, a sheet supply subroller 112, and a separation roller 113 as components for feeding the medium from the inside of the sheet supply unit 11. The sheet supply roller 111 is a roller which feeds the medium toward the transferring unit 15. The sheet supply subroller 112 is a roller which feeds the medium toward the sheet supply roller 111. The separation roller 113 is a roller which is provided to the sheet supply roller 111 via the main carrying path 8 and which separates the media into individual sheets by sandwiching each medium with the sheet supply roller 111. The sheet supply roller 111 and the sheet supply subroller 112 are configured as drive rollers which are driven by a main motor 51 (see FIG. 2).

In addition, as shown in FIG. 1C, the medium carrying mechanism 12 has carrying rollers 121*a*, 122*a*, 123*a*, 124*a* and 125*a*, and pinch rollers 121*b*, 122*b* and 125*b* as components for carrying the medium.

The carrying rollers 121*a*, 122*a*, 123*a* and 125*a* are configured as drive rollers which rotate by the driving force of the main motor 51 (see FIG. 2) being transmitted by gears (not shown). Here, the carrying roller 123*a* is connected with the carrying roller 124*a* by a drive belt 126 (see FIG. 4). The drive belt 126 is tensioned between a gear (not shown) provided on the axial part of the carrying roller 123*a* and a gear (not shown) provided on the axial part of the carrying roller 124*a*. As the carrying roller 123*a* rotates in the direction indicated by the arrow in FIG. 4, the rotation and drive of the carrying roller 123*a* is transmitted by the drive belt 126, and thereby the carrying roller 124*a* rotates in the same direction as the carrying roller 123*a*.

The pinch rollers 121*b*, 122*b* and 125*b* are rollers provided to oppose the carrying rollers 121*a*, 122*a* and 125*a*, respectively, via the main carrying path 8 or the inversion carrying path 9. Here, the pinch rollers 123*b* and 124*b* are provided to oppose the carrying rollers 123*a* and 124*a*, respectively, via the inversion carrying path 9 in the lower surface side of the transferring unit 15. The pinch rollers 121*b*, 122*b*, 123*b*, 124*b* and 125*b* produce a carrying force by pressing onto their opposing carrying rollers 121*a*, 122*a*, 123*a*, 124*a* and 125*a*, respectively, and are rotated by being dragged by the opposing carrying rollers 121*a*, 122*a*, 123*a*, 124*a* and 125*a*, respectively.

Among these rollers, the carrying roller 122*a* functions as a roller which controls registration of a medium. That is, the carrying roller 122*a* functions as a registration roller. In addition, the carrying rollers 123*a* and 124*a* function as rollers which carry the medium in the inversion direction. The carrying roller 125*a* functions as a roller which returns the medium to the main carrying path 8 and which recarries the medium. In addition, the pinch roller 122*b* functions as a roller which presses the medium onto the registration roller 122*a*. Hereafter, when distinguishing them, the carrying rollers 122*a*, 123*a*, 124*a* and 125*a*, and the pinch roller 122*b* are called "registration roller 122*a*", "inversion carrying rollers 123*a* and 124*a*", "recarrying roller 125*a*", and "pressure roller 122*b*".

The image forming unit 13 is a unit which has a photosensitive body (e.g., photosensitive drum 131), a charging unit 132 (see FIG. 2), and a development unit 133 (see FIG. 2), and which forms a developer image on the surface of the photosensitive drum 131. The photosensitive drum 131 is an image carrier, on the surface of which the developer image is formed. The charging unit 132 is a component which uniformly charges the surface of the photosensitive drum 131. The development unit 133 is a component which supplies toner as a developer to the photosensitive drum 131 after the exposure unit 14 partially exposes the surface of the photosensitive drum 131. The photosensitive drum 131 is rotated by the driving force of the main motor 51 (see FIG. 2) transmitted by a gear (not shown). At that time, the charging unit 132 uniformly charges the surface of the photosensitive drum 131, and further the exposure unit 14 partially exposes the charged surface of the photosensitive drum 131.

The exposure unit 14 is a unit which partially exposes the surface of the photosensitive drum 131. After the charging unit 132 uniformly charges the surface of the photosensitive drum 131, the exposure unit 14 partially exposes the surface of the photosensitive drum 131 based on print data received from a host device such as a personal computer and the like. Thereby, the exposure unit 14 forms an electrostatic latent image on the surface of the photosensitive drum 131. Here, explanation is given assuming a case where the exposure unit 14 is configured with an LED head with a large number of LED elements built in as light-emitting elements. Hereafter, the exposure unit 14 is called an "LED head 14".

Here, once the exposure unit 14 has partially exposed the surface of the photosensitive drum 131 to light, the development unit 133 supplies a developer (toner) to the photosensitive drum 131. Thereby, the electrostatic latent image is developed as a developer image (toner image).

The transferring unit 15 is a unit which transfers the developer image formed on the surface of the photosensitive drum 131 to the medium. As shown in FIG. 1B, the transferring unit 15 has a transferring roller 151 and a spring 152. The transferring roller 151 is a roller which functions as a carrying member that carries the medium and as a transferring member that transfers the developer image to the medium. The transferring roller 151 is provided to oppose the photosensitive drum 131 via the main carrying path 8. The transferring roller 151 rotates by the driving force of the main motor 51 (see FIG. 2) transmitted by a gear (not shown). The spring 152 presses the transferring roller 151 onto the photosensitive drum 131 in a freely-rotatable state.

In transferring the developer image, the transferring roller 151 is charged, while carrying the medium, with a transferring voltage of the polarity opposite to that of the developer image formed on the surface of the photosensitive drum 131. Thereby, the transferring roller 151 transfers the developer image onto the medium by attracting the developer image formed on the surface of the photosensitive drum 131 from the photosensitive drum 131 side toward the medium side.

The fuser unit 16 is a unit which fixes onto the medium the developer image transferred to the medium. As shown in FIG. 1B, the fuser unit 16 has a fusion roller 161 and a pressure application roller 162 provided to oppose each other via the main carrying path 8. The fusion roller 161 is configured as a drive roller which is rotated by the driving force of the main motor 51 (see FIG. 2) being transmitted by a gear (not shown). As shown in FIG. 1B, the fusion roller 161 has a heater 163 (see FIG. 2) therein. The pressure application roller 162 is a roller provided to oppose the fusion roller 161 via the main carrying path 8. The pressure application roller 162 produces a carrying force by applying a pressure to the fusion roller 161 and is rotated by being dragged by the fusion roller 161.

The fuser unit 16 presses and heats a medium by carrying the medium by the fusion roller 161 and the pressure application roller 162 with the heater 163 operating. Thereby, the fuser unit 16 fuses the developer transferred onto the medium and fixes the developer image on the medium.

The ejection unit 17 is a unit which carries the medium on which the developer image has been fixed and ejects the medium to the medium stacking part 19 provided on the top cover 3. The ejection unit 17 has ejection rollers 171*a* and 172*a* and pinch rollers 171*b* and 172*b* as components for carrying the medium. The ejection rollers 171*a* and 172*a* are configured as drive rollers which are rotated by the driving force of the ejection motor 52 (see FIG. 2) being transmitted by gears (not shown). The pinch rollers 171*b* and 172*b* are rollers provided to oppose the ejection rollers 171*a* and 172*a*, respectively, via the main carrying path 8. The pinch rollers 171*b* and 172*b* produces a carrying force by applying a pressure to the respective opposing ejection rollers 171*a* and 172*a* and are rotated by being dragged by the respective opposing ejection rollers 171*a* and 172*a*.

The ejection unit 17 carries the medium to the medium stacking part 19 using the ejection rollers 171*a* and 172*a* and the pinch rollers 171*b* and 172*b*, and ejects and stacks the medium onto the medium stacking part 19.

Here, as shown in FIG. 1C, the printer 1 has an ejection sensor lever SNL and an ejection sensor SN1 provided around the main carrying path 8 in the downstream side of the fuser unit 16. In addition, a separator 129 which distributes the medium being carried is provided between the pair of the ejection sensor lever SNL and the ejection sensor SN1 and the pair of the ejection roller 171*a* and the pinch roller 171*b*.

The printer 1 carries the medium along the main carrying path 8. At that time, the printer 1 forms a developer image on the surface of the photosensitive drum 131 using the image forming unit 13 and the exposure unit 14, transfers the developer image from the photosensitive drum 131 onto the medium, and fixes the developer image on the medium using the fuser unit 16.

Then, in the printer 1, when the medium passes above the ejection sensor lever SNL, the ejection sensor lever SNL swings. In response, the value of an output signal outputted from the ejection sensor SN1 changes. The printer 1 detects that the medium has passed above the ejection sensor lever SNL by detecting a change in the value of the output signal of the ejection sensor SN1. Then, when a specified length of time has passed since detecting the change in the value of the output signal of the ejection sensor SN1, the printer 1 judges that the medium has passed over the separator 129.

When the medium is judged to have passed over the separator 129 in performing one-side printing, the printer 1 rotates the ejection motor 52 (see FIG. 2) in the forward direction and rotates the ejection rollers 171*a* and 172*a* of the ejection unit 17 in the forward direction. Thereby, the printer 1 ejects the medium onto the medium stacking part 19 and stacks the medium on the medium stacking part 19.

On the other hand, if the medium is judged to have passed over the separator 129 in performing double-sided printing, the printer 1 reverses the rotational direction of the ejection motor 52 (see FIG. 2) and rotates the ejection rollers 171*a* and 172*a* of the ejection unit 17 in the reverse direction. Thereby, the printer 1 sends the medium from the main carrying path 8 to the inversion carrying path 9.

After sending a medium from the main carrying path 8 to the inversion carrying path 9, the printer 1 carries the medium along the inversion carrying path 9. At this time, the printer 1 carries the medium to the position of the recarrying roller 125*a* and the pinch roller 125*b* of the medium carrying mechanism 12 by the inversion carrying rollers 123*a* and 124*a* of the medium carrying mechanism 12 and the pinch rollers 123*b* and 124*b* of the transferring unit 15, and further sends the medium from the inversion carrying path 9 to the main carrying path 8 by the recarrying roller 125*a* and the pinch roller 125*b*. In that process, the front surface and the back surface of the medium are inverted. As a result, the front surface of the medium with the image formed thereon is oriented toward the fuser unit 15 side, and the rear surface with no image formed thereon is oriented toward the image forming unit 13 side.

After sending the medium from the inversion carrying path 9 to the main carrying path 8, the printer 1 carries the medium along the main carrying path 8. At this time, the printer 1 forms a developer image on the surface of the photosensitive drum 131 by the image forming unit 13 and the exposure unit 14, transfers the developer image from the photosensitive drum 131 to the medium by the transferring unit 15, and fixes the developer image on the medium by the fuser unit 16. Thereby, the printer 1 performs printing on both sides of the medium.

Then, when a specified time has passed after detecting a change in the value of the output signal of the ejection sensor SN1, the printer 1 judges that the medium has passed over the separator 129. Once it is judged that the medium has passed over the separator 129, the printer 1 rotates the ejection motor 52 (see FIG. 2) in the forward direction and rotates the ejection rollers 171*a* and 172*a* of the ejection unit in the forward direction. Thereby, the printer 1 ejects the medium onto the medium stacking part 19 and stacks it on the medium stacking part 19.

<Configuration of the Control System of an Image Forming Apparatus>

Figure 2:
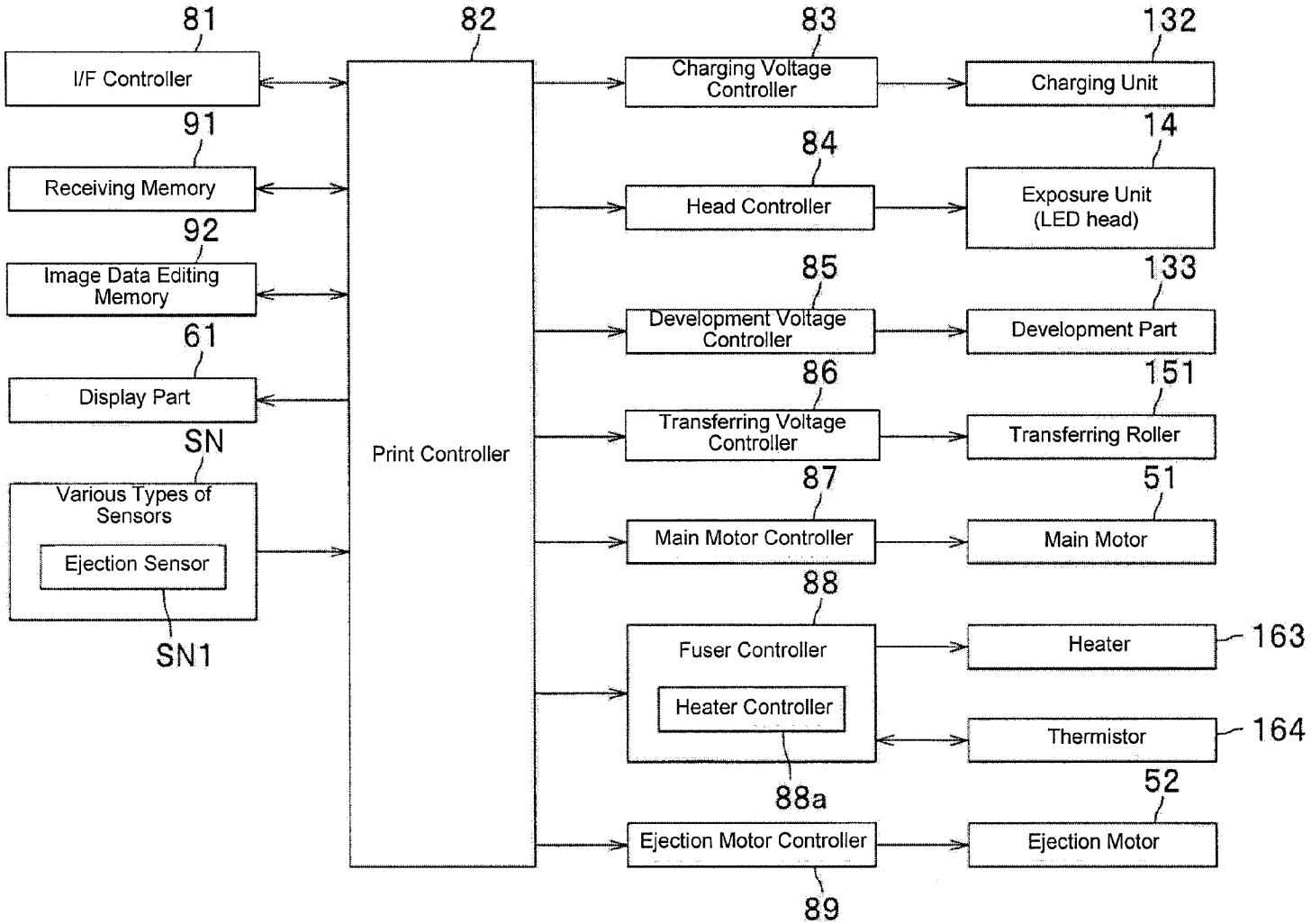
FIG. 2 is a figure showing the configuration of a control system of the image forming apparatus of the first embodiment.

Below, explanations are given on the configuration of the control system of the image forming apparatus of the first embodiment by referring to FIG. 2. FIG. 2 is a figure showing the configuration of a control system of the image forming apparatus of the first embodiment.

As shown in FIG. 2, the printer 1 has an interface (I/F) controller 81, a print controller 82, a charging voltage controller 83, a head controller 84, a development voltage controller 85, a transferring voltage controller 86, a main motor controller 87, a fuser controller 88, an ejection motor controller 89, a receiving memory 91, and an image data editing memory 92.

The I/F controller 81 is a functional device to perform sending/receiving data with external devices. The I/F controller 81 sends print information to the host device and receives print data and various types of commands from the host device.

The print controller 82 is a functional device to process data received from the host device. When the data received from the host device is print data, the print controller 82 analyzes the print data, controls the whole sequence of the printer 1, and performs a printing action. In addition, the print controller 82 displays various types of information on a display part 61 and detects various states of the device by detecting the values of output signals from various types of sensors SN, including the ejection sensor SN1. The print controller 82 is configured from a microprocessor, a read-only memory (ROM), a random access memory (RAM), an input/output port, a timer, and the like.

The charging voltage control unit 83 is a functional device to perform a control to apply a voltage to the charging unit 132 in accordance with an instruction of the print controller 82. The charging unit 132 uniformly charges the surface of the photosensitive drum 131 by the applied voltage.

The head controller 84 is a functional device to control operation of the LED head 14 as the exposure unit in accordance with an instruction of the print controller 82. The head controller 84 drives the LED head 14 based on the image data stored in the image data editing memory 92. At this time, the LED head 14 partially illuminates the surface of the photosensitive drum 131 with light and partially expose the surface of the photosensitive drum 131. Thereby, the LED head 14 forms an electrostatic latent image on the surface of the photosensitive drum 131 which is uniformly charged by the charging unit 132.

The development voltage controller 85 is a functional device to perform a control to apply a voltage to the development unit 133 in accordance with an instruction of the print controller 82. As the voltage is applied, the development unit 133 supplies a developer (toner) to the photosensitive drum 131 to cause the developer to attach onto the surface of the photosensitive drum 131. Thereby, the development unit 133 develops the electrostatic latent image formed on the surface of the photosensitive drum 131 by the LED head 14 as a developer image (toner image).

The transferring voltage controller 86 is a functional device to perform a control to apply a voltage to the transferring roller 151 in accordance with an instruction of the print controller 82. As the voltage is applied, the transferring roller 151 attracts the developer image formed on the surface of the photosensitive drum 131 and transfers the developer image from the photosensitive drum 131 onto the medium.

The main motor controller 87 is a functional means to control the driving of the main motor 51 following the instructions of the print controller 82. Here, the main motor 51 drives the sheet supply roller 111, the sheet supply subroller 112, the carrying rollers 121*a*, 122*a*, 123*a*, 124*a* and 125*a*, the photosensitive drum 131, a charging roller (not shown) of the charging unit 132, a development roller (not shown) of the development unit 133, the transferring roller 151, and the fusion roller 161, for example, at the time of paper supply, carrying, or fusion (see FIG. 1C).

The fuser controller 88 is a functional device to control the driving of the fuser unit 16 in accordance with an instruction of the print controller 82. The fuser controller 88 includes a heater controller 88*a* which controls the on/off operations of the heater 163 of the fuser unit 16. The heater controller 88*a* controls the on/off operations of the heater 163 based on the temperature of the fuser unit 16 measured by a thermistor 164. Thereby, the heater controller 88*a* heats up the heater 163 to a specified temperature or higher. Then, the fuser unit 16 carry the medium which sandwiching the medium using the fusion roller 161 and the pressure application roller 162 while heating the medium by the heater 163, thereby melting the developer transferred onto the medium. As a result, the fuser unit 16 fixes the developer image on the medium.

The ejection motor controller 89 is a functional device to control the driving of the ejection motor 52 in accordance with an instruction of the print controller 82. The ejection motor 52 drives the ejection rollers 171*a* and 172*a* when ejecting the medium or feeding the medium to the inversion carrying path 9 (see FIG. 1C).

The receiving memory 91 is a component which stores data received from the host device. When data is received from the host device, the print controller 82 stores the received data in the receiving memory 91.

The image data editing memory 92 is a component which stores image data edited by the print controller 82 based on print data. When the data received from the host device is print data of a color image for example, the print controller 82 analyzes the print data to obtain the image data of each color and stores the obtained image data of each color in the image data editing memory 92.

Here, in performing single-sided printing, if the medium is determined to have passed over the separator 129 according to the output signal from the ejection sensor SN1, the print controller 82 causes the ejection motor controller 89 to perform a rotation control of the ejection motor 52 in the forward direction. In addition, in performing double-sided printing, if the medium is determined to have passed over the separator 129 according to the output signal from the ejection sensor SN1 at the completion of the front-side printing, the print controller 82 causes the ejection motor controller 89 to perform a rotation control of the ejection motor 52 in the reverse direction. Further, if the medium is determined to have passed over the separator 129 according to the output signal from the ejection sensor SN1 at the completion of the back-side printing, the print controller 82 causes the ejection motor controller 89 to perform a rotation control of the ejection motor 52 in the forward direction.

In addition, the print controller 82 is connected with a display part 61 such as a liquid crystal display (LCD) or the like which displays the state of the printer 1 in detail to the user. In addition, the print controller 82 is connected with a plurality of sensors SN of various types, such as the ejection sensor SN1 and the like. The plurality of sensors SN are sensors and the like which detect the temperature and humidity inside the printer 1 or detect the carrying location of the medium, for example.

<Internal Configuration of the Image Forming Apparatus>

Figure 3A:
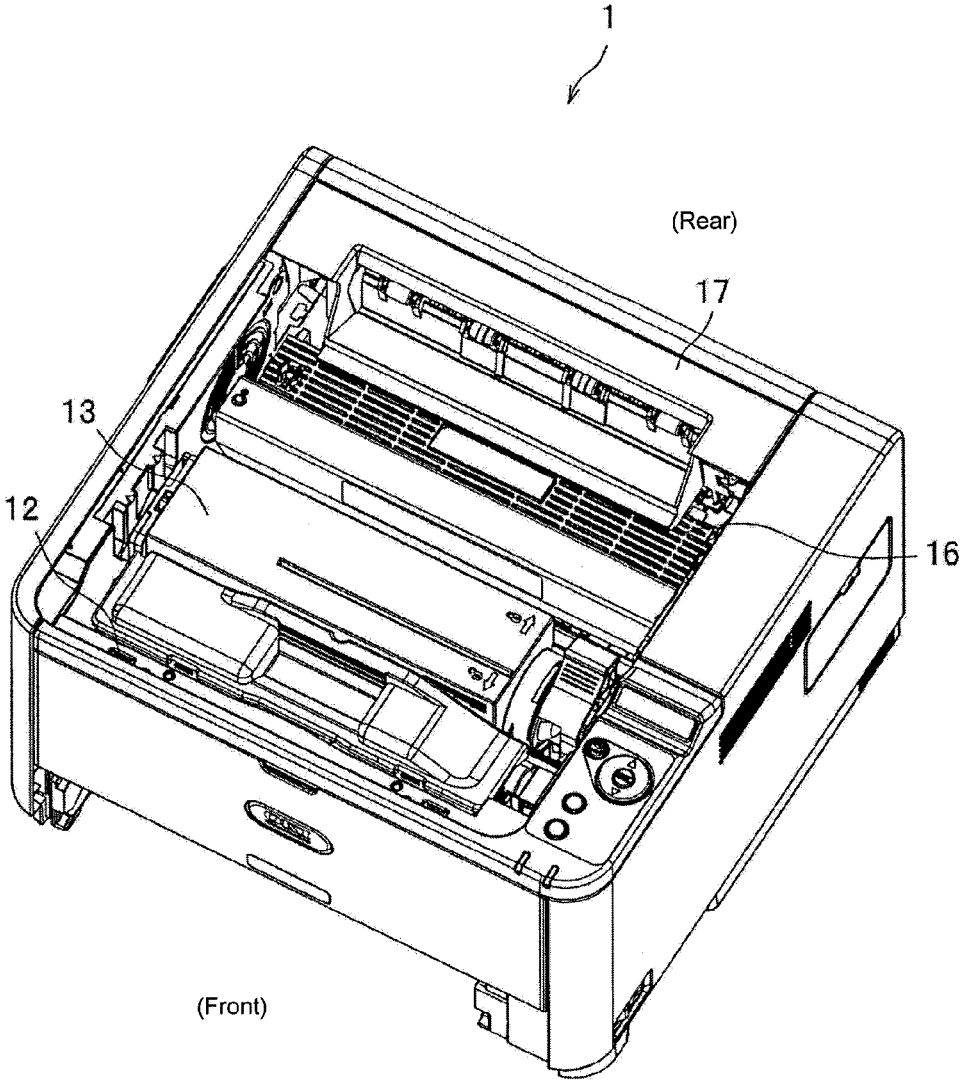
FIG. 3A is a first figure showing the internal configuration of the image forming apparatus of the first embodiment.
Figure 3B:
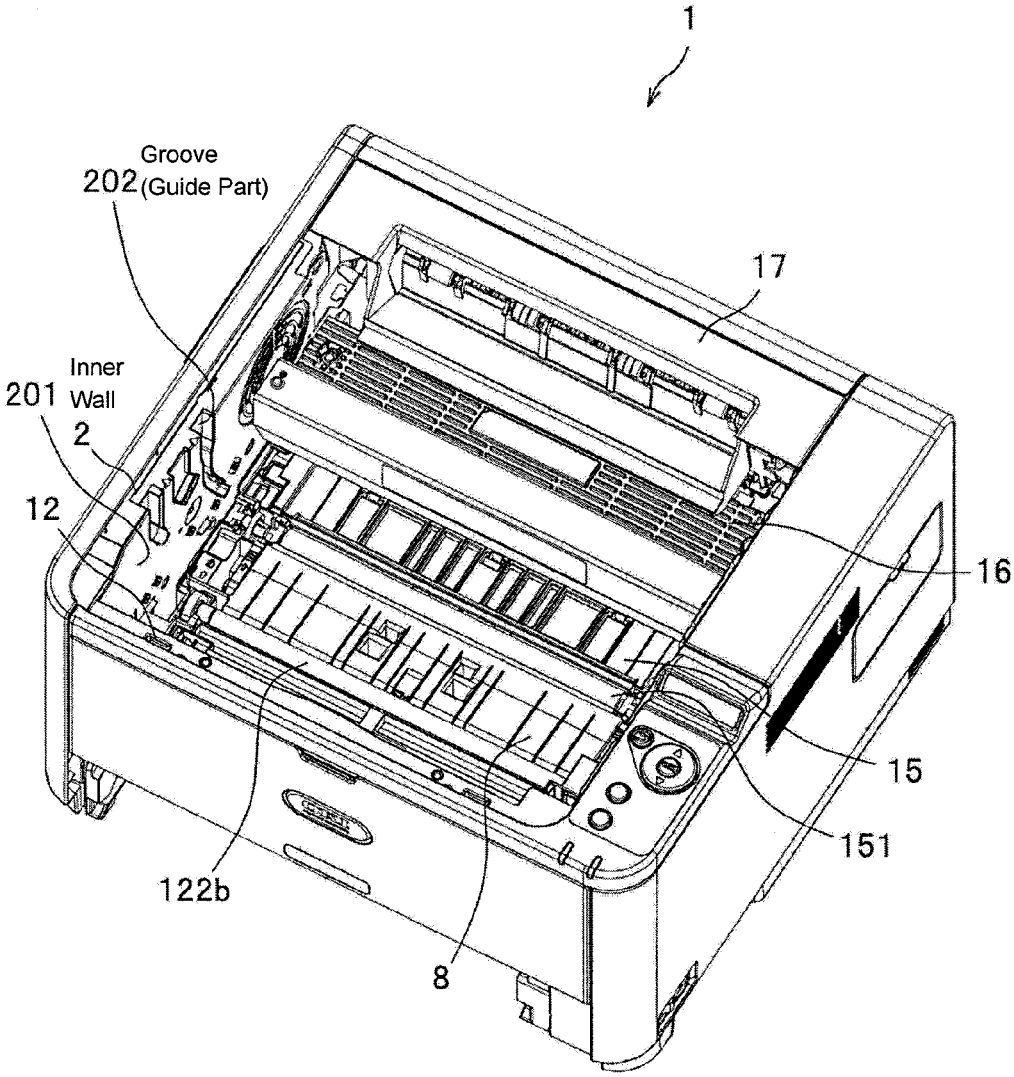
FIG. 3B is a second figure showing the internal configuration of the image forming apparatus of the first embodiment.
Figure 3C:
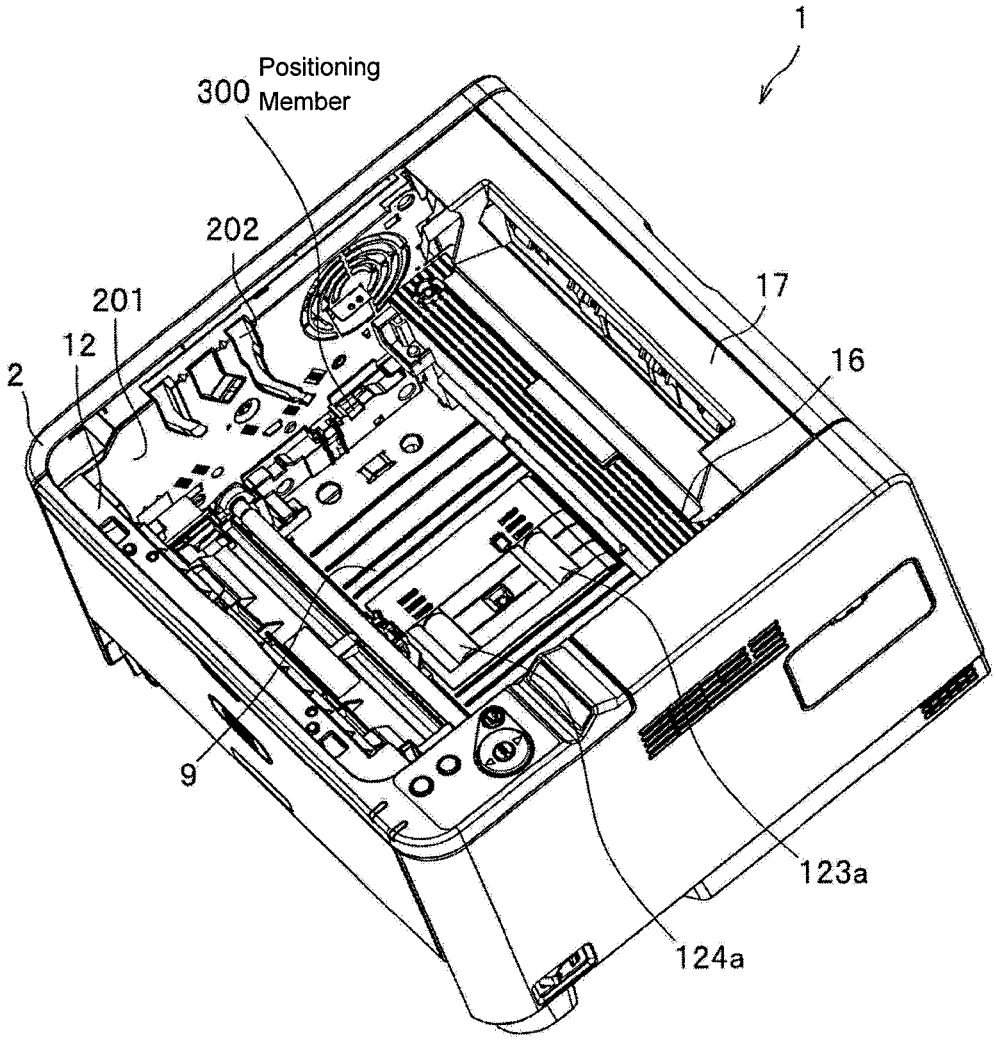
FIG. 3C is a third figure showing the internal configuration of an image forming apparatus of the first embodiment.

Below, the internal configuration of the printer 1 is explained referring to FIGS. 3A-3C. FIGS. 3A-3C each are figures showing the internal configuration of the image forming apparatus of the first embodiment. FIGS. 3A-3C each are perspective views schematically showing the internal configuration of the printer 1. FIGS. 3A-3C each show the internal configuration of the printer 1 without the top cover 3 (see FIG. 1A) for easy understanding FIG. 3A shows the configuration where the image forming unit 13 is installed. FIG. 3B shows the configuration where the image forming unit 13 is removed. FIG. 3C shows the configuration where the transferring unit 15 is removed.

As shown in FIG. 3A, components such as the medium carrying mechanism 12, the image forming unit 13, the exposure unit 14 (see FIG. 1A), the fuser unit 16, the ejection unit 17 and the like are arranged inside the printer 1.

As shown in FIG. 3B, when the image forming unit 13 and the exposure unit 14 (see FIG. 1A) are removed from the printer 1, the transferring unit 15 as a medium carrying unit appears. Here, the printer 1 includes grooves 202 provided on both right and left inner walls 201 of the casing 2 of the transferring unit 15. The grooves 202 function as guiding parts for guiding a shaft part 131*a* (see FIGS. 4 and 7) of the photosensitive drum 131 of the image forming unit 13 to a specified position when the image forming unit 13 is installed. Hereafter, the grooves 202 are called "guide parts 202".

As shown in FIG. 3C, when the transferring unit 15 is removed from the printer 1, the inversion carrying path 9, the inversion carrying rollers 123*a* and 124*a*, and a positioning member 300 appear. Here, the positioning member 300 is provided on both the right and left sides of the transferring unit 15. Here, the "positioning member 300" is a member for positioning the transferring unit 15.

<Configuration and Actions of the Medium Carrying Unit>

Below, the configuration and operation of the transferring unit 15 as the medium carrying unit of the first embodiment is explained referring to FIGS. 4, 5, 6A-6C, 7 and 8.

Figure 4:
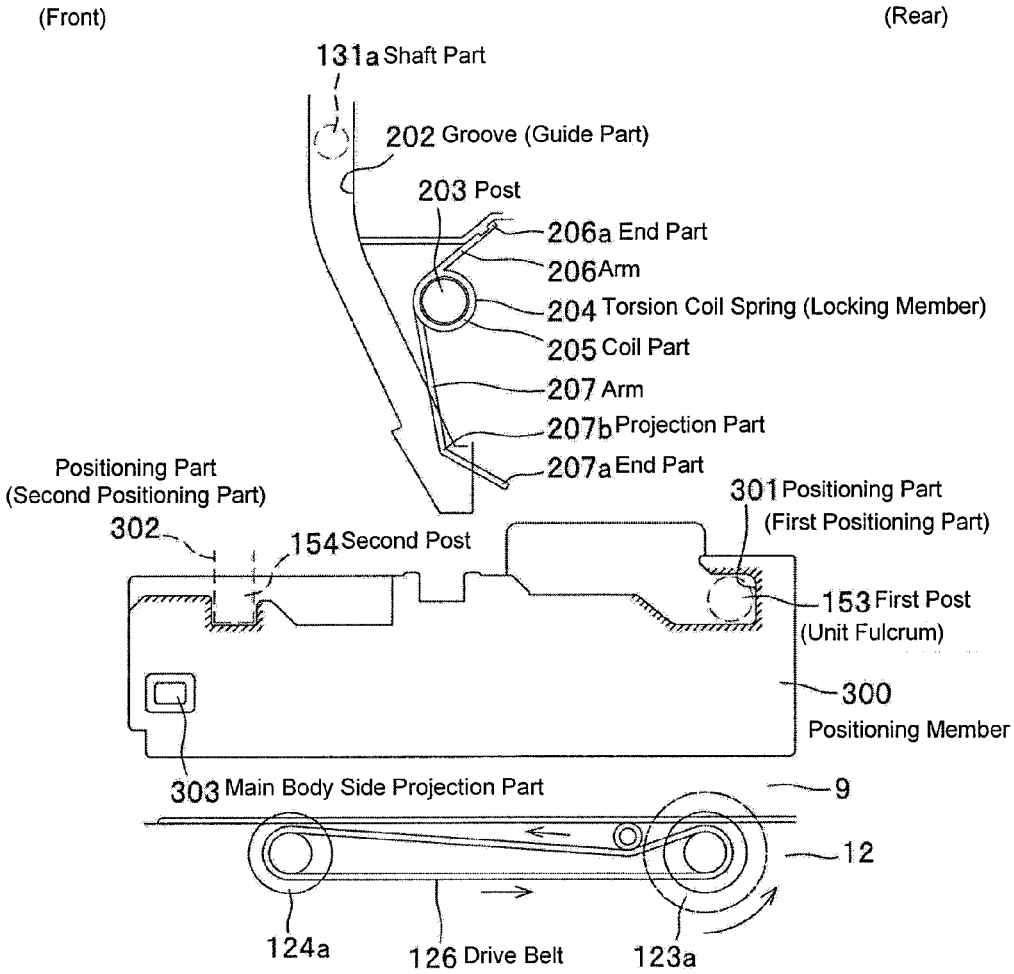
FIG. 4 is a figure showing the peripheral configuration of the medium carrying unit of the first embodiment.
Figure 5:
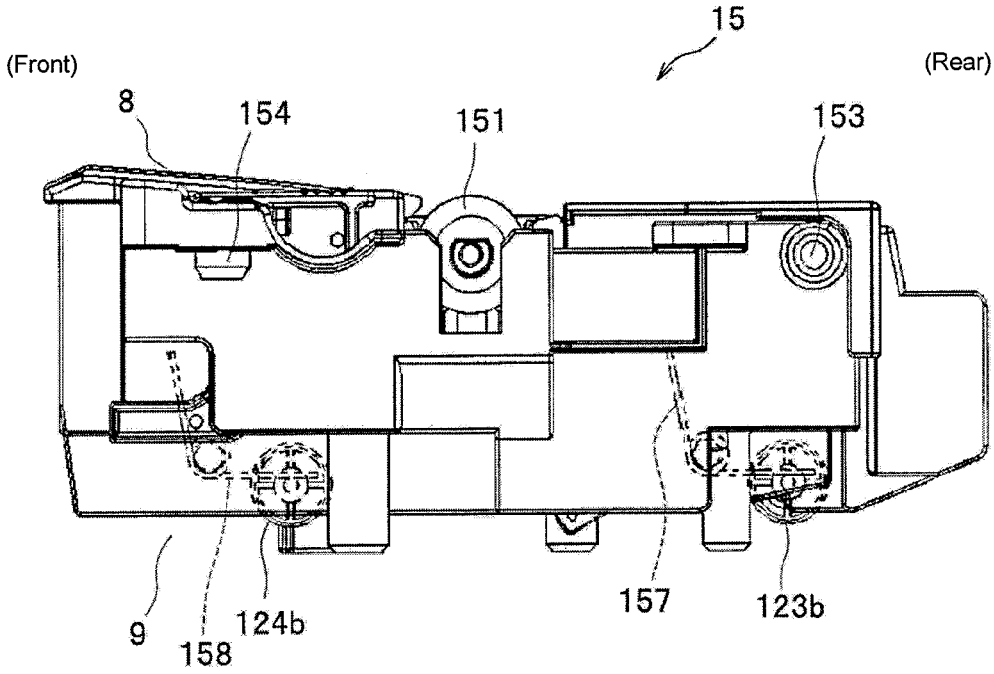
FIG. 5 is a first figure showing the configuration of the medium carrying unit of the first embodiment.
Figure 6A:
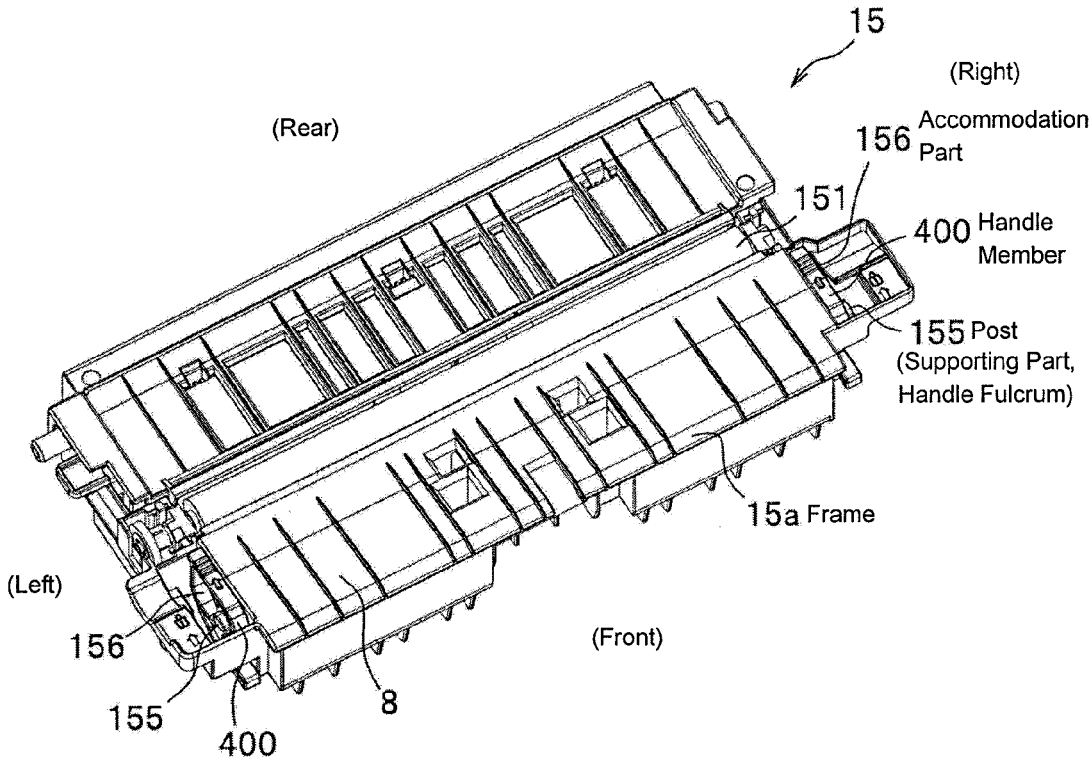
FIG. 6A is a second figure showing the configuration of the medium carrying unit of the first embodiment.
Figure 6B:
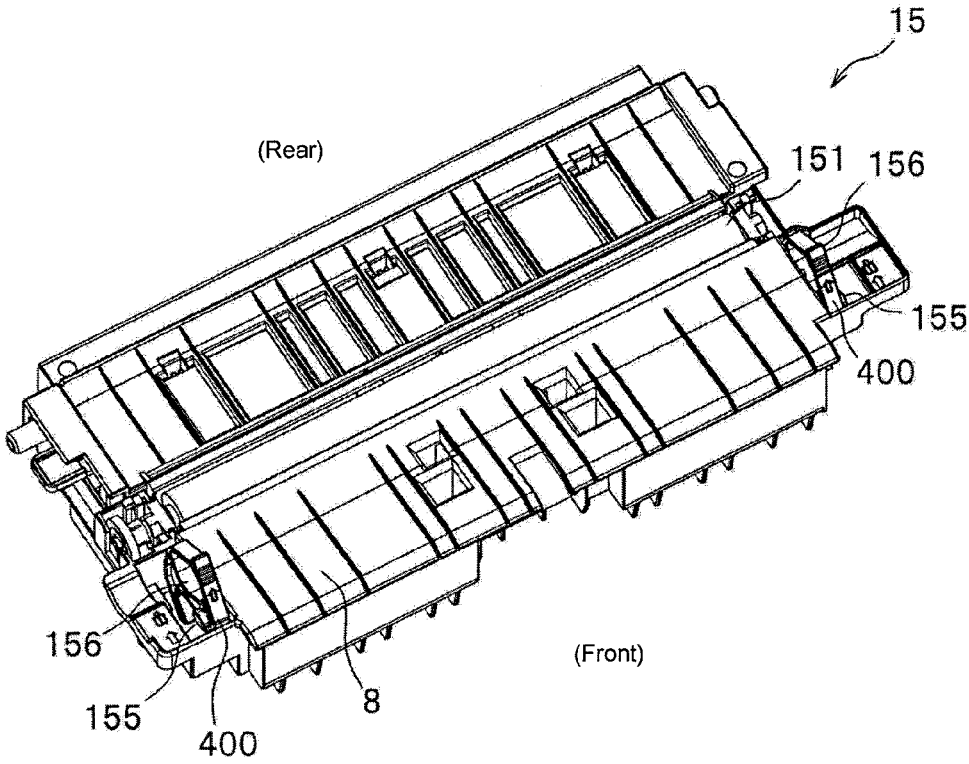
FIG. 6B is a third figure showing the configuration of the medium carrying unit of the first embodiment.
Figure 6C:
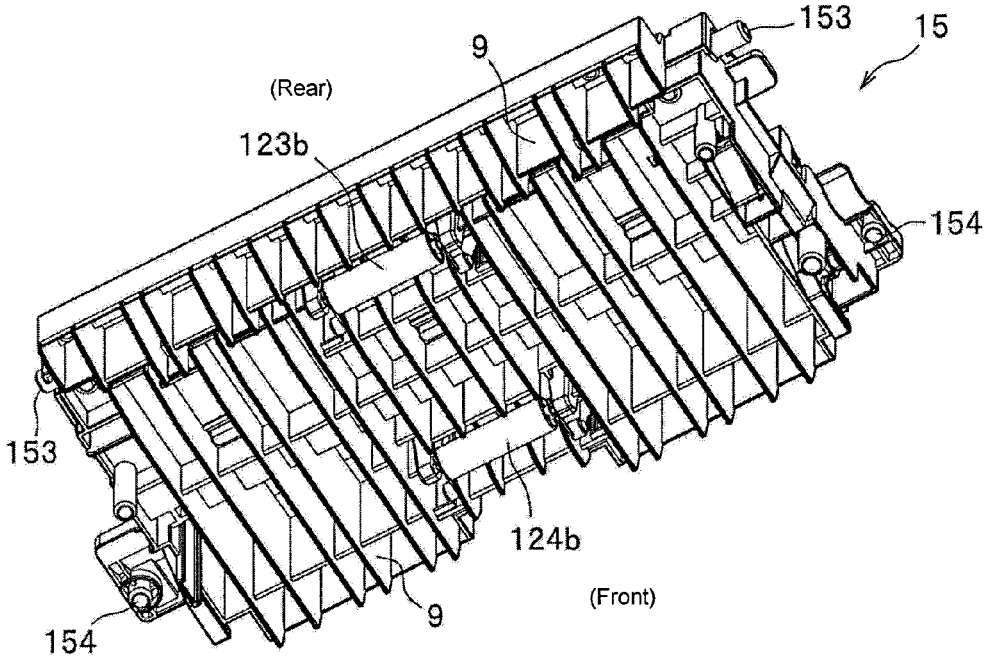
FIG. 6C is a fourth figure showing the configuration of the medium carrying unit of the first embodiment.

FIG. 4 shows the peripheral configuration of the medium carrying unit of the first embodiment. FIG. 4 is a side view of the peripheral configuration of the transferring unit 15. FIGS. 5 and 6A-6C each show the configuration of the medium carrying unit of the first embodiment. FIG. 5 is a side view of the configuration of the transferring unit 15. FIGS. 6A and 6B are left side front view of the configuration of the transferring unit 15. FIG. 6A shows a state where the handle member 400 which is a feature part of the first embodiment is stored in an accommodation area 156. On the other hand, FIG. 6B shows a state where the handle member 400 is projecting from the accommodation area 156. FIG. 6C is a bottom view of the configuration of the transferring unit 15.

Figure 7:
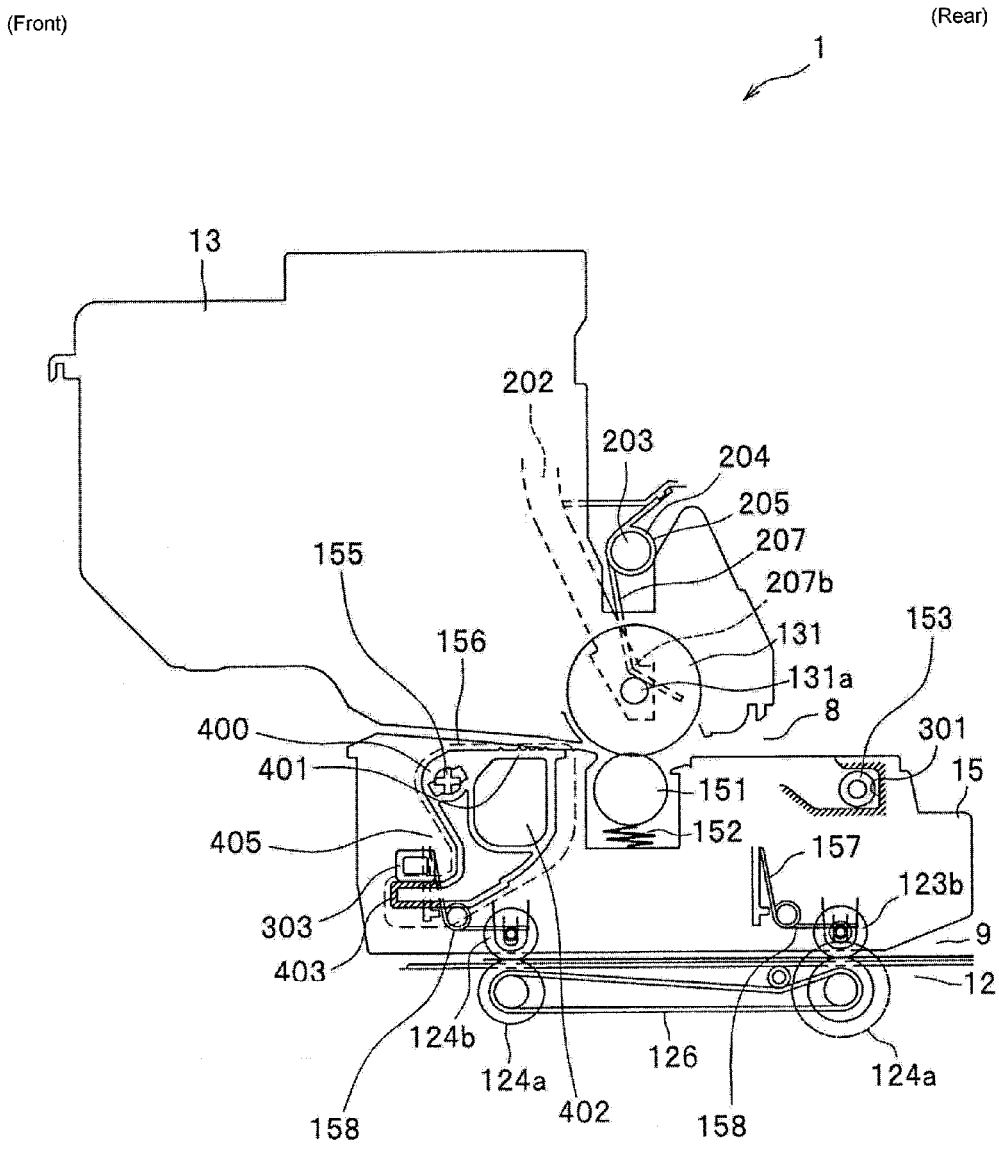
FIG. 7 is a figure showing the configuration of the image forming apparatus in a state where the medium carrying unit of the first embodiment is installed.
Figure 8A:
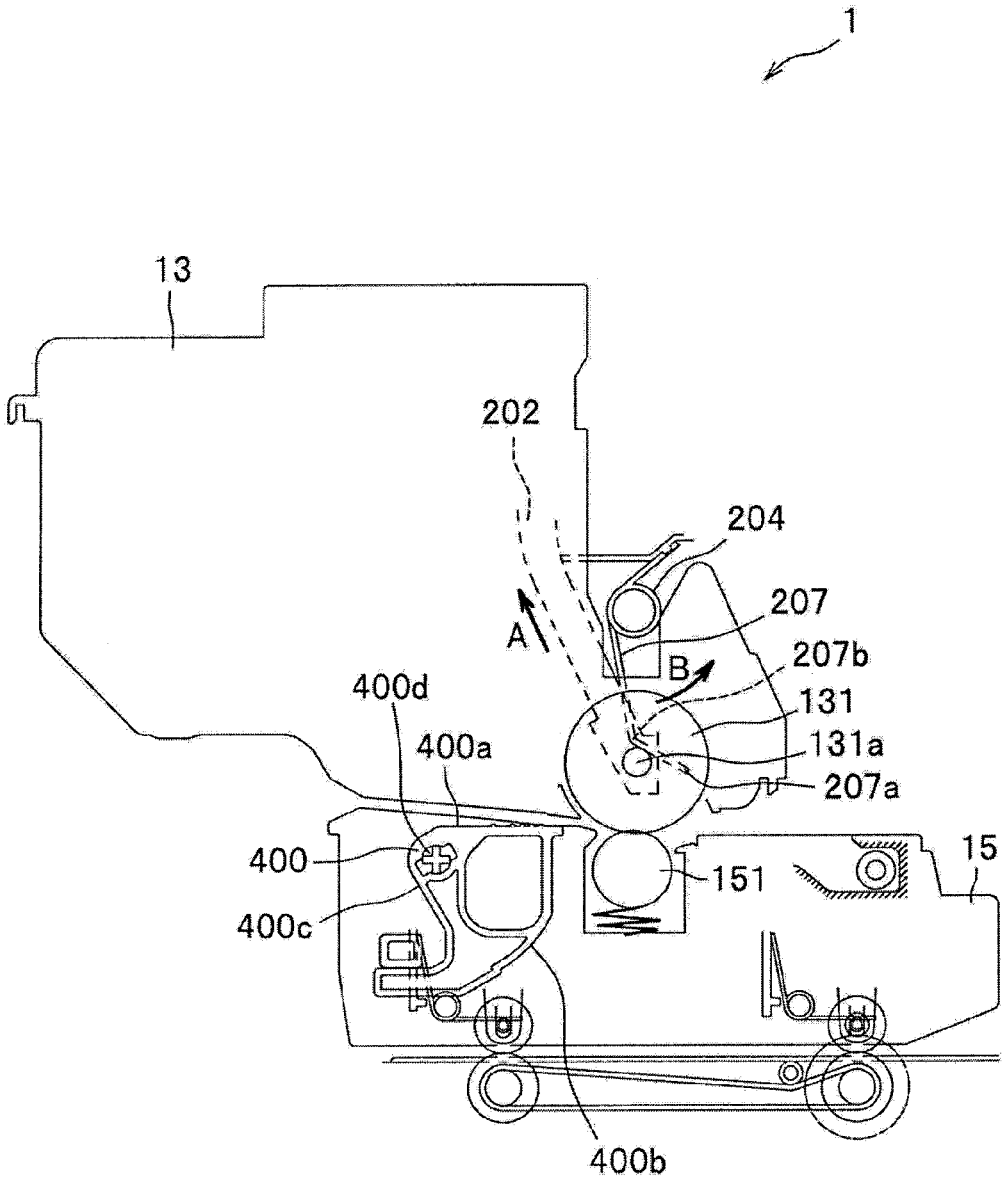
FIG. 8A is a first figure showing operation of the medium carrying unit of the first embodiment.
Figure 8B:
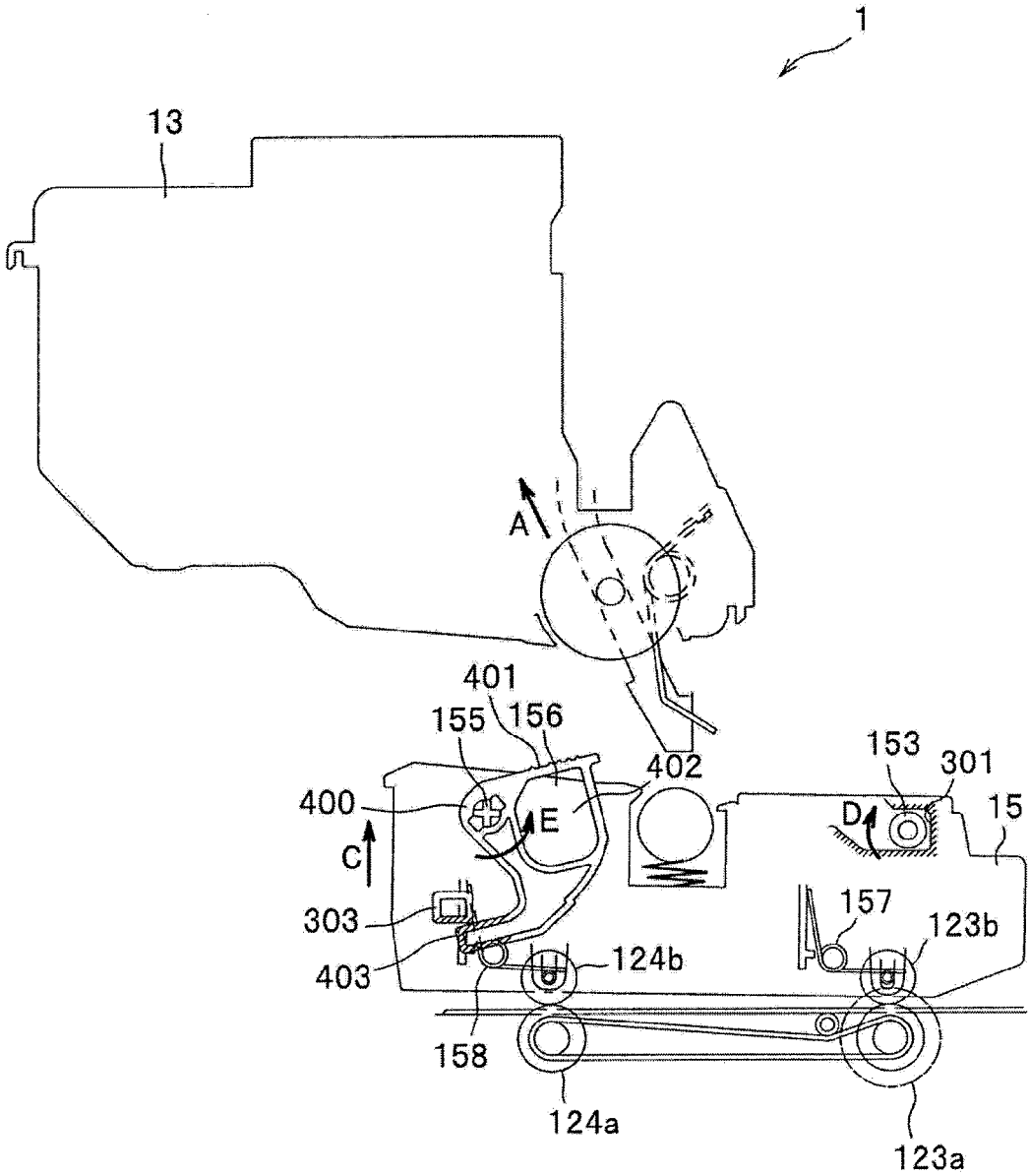
FIG. 8B is a second figure showing the operation of the medium carrying unit of the first embodiment.
Figure 8C:
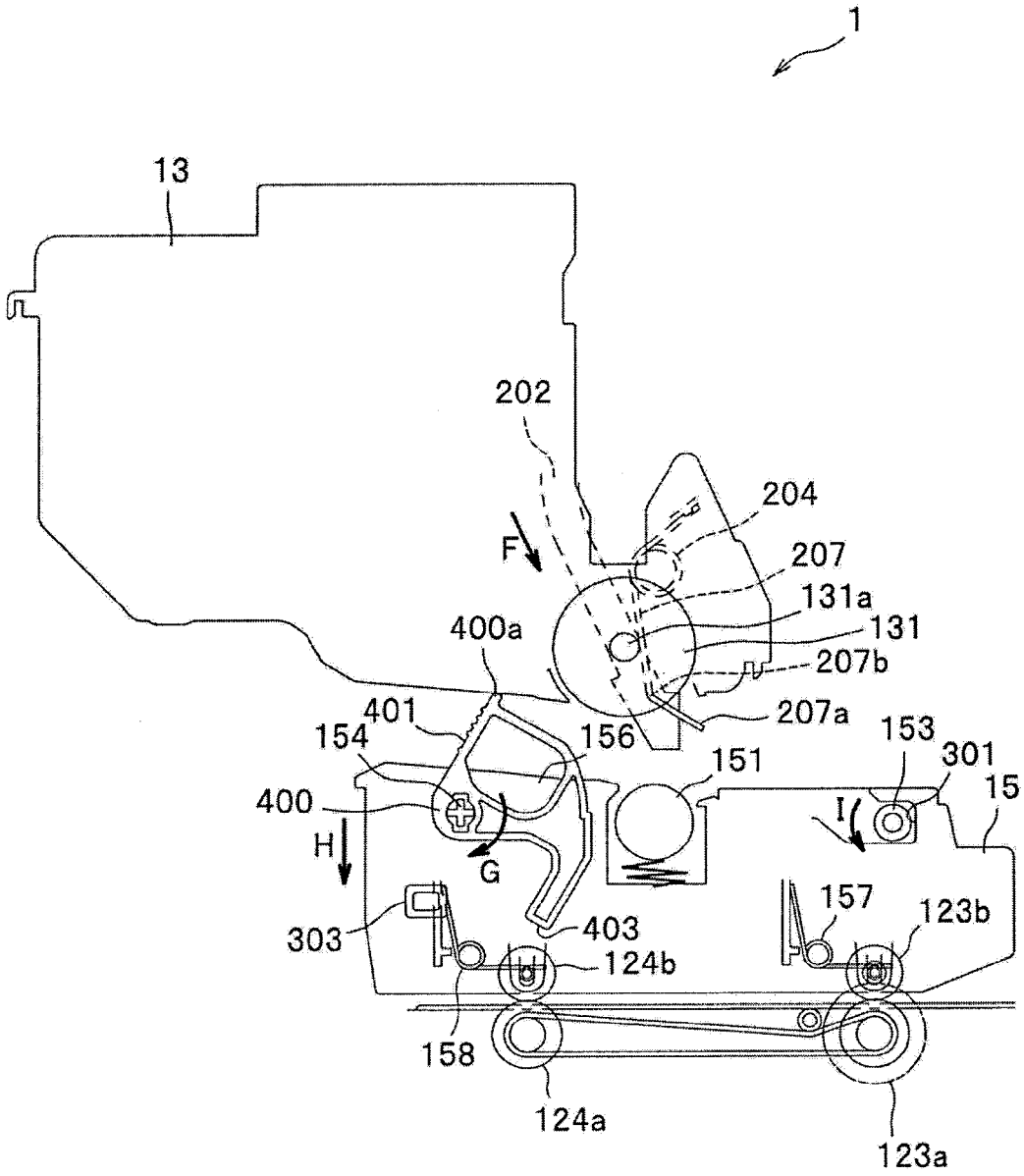
FIG. 8C is a third figure showing the operation of the medium carrying unit of the first embodiment.

FIG. 7 is a figure showing the configuration of the image forming apparatus in a state where the medium carrying unit of the first embodiment is installed. FIG. 7 shows the configuration of the printer 1 in a state where the transferring unit 15 is installed to the apparatus main body, and further where the image forming unit 13 is installed on the transferring unit 15. FIGS. 8A-8C each show the operation of the medium carrying unit of the first embodiment.

First, the peripheral configuration of the transferring unit 15 is explained referring to FIG. 4. As shown in FIG. 4, the printer 1 includes the guide parts 202 and the positioning member 300 around the transferring unit 15.

The guide parts 202 are grooves provided on the inner walls 201 of the casing 2 for guiding the shaft part 131*a* of the photosensitive drum 131 of the image forming unit 13 (see FIG. 7) to a specified position when the image forming unit 13 is installed. When the image forming unit 13 is installed, the shaft part 131*a* of the photosensitive drum 131 (see FIG. 7) passes through the guide parts 202. The lower end side of the guide parts 202 is configured to curve from the middle part toward the rear direction.

Here, the printer 1 includes a torsion coil spring 204 (hereafter, simply called "spring 204") provided inside the inner walls 201 of the casing 2 (see FIGS. 3B and 3C) around the lower end side of the guide parts 202. The spring 204 includes a coil part 205 attached to a post 203 provided inside the inner wall 201. With the coil part 205 as an axis, an end part 206*a* of one arm 206 is positioned as a fixed end part, and an end part 207*a* of the other arm 207 is set as a free end. The arm 207 of the spring 204 is bent in an L shape in the middle, by which a projection 207*b* which projects into the guide parts 202 is formed. The spring 204 functions as a locking member which positions the photosensitive drum 131 of the image forming unit 13 in a freely-rotatable manner by the projection 207*b* engaging with the shaft part 131*a* when the shaft part 131*a* of the photosensitive drum 131 of the image forming unit 13 (see FIG. 7) passes through the interior of the guide parts 202.

In addition, as described above, the positioning member 300 is a member for positioning the transferring unit 15. The positioning member 300 includes positioning parts 301 and 302 in the upper part. In addition, the positioning member 300 includes a main body side projection part 303 which projects toward the transferring unit 15 side.

The positioning part 301 is a groove which engages with a first post 153 (see FIG. 5) that is provided on the transferring unit 15 and that projects laterally (right-left direction of the transferring unit 15). The positioning part 302 is a groove which engages with a second post 154 (see FIG. 5) that is provided on the transferring unit 15 and that projects in a downward direction. Hereafter, when the positioning part 301 and the positioning part 302 are distinguished, the positioning part 301 and the positioning part 302 are respectively called "the first positioning part 301" and "the second positioning part 302".

The first positioning part 301 is formed so that an opening faces an oblique rear direction of the printer 1 and further a bottom part faces the rear direction of the printer 1. The first positioning part 301 positions the transferring unit 15 in the depth direction (rear direction of the device) by engaging with the first post 153 (see FIG. 5) of the transferring unit 15.

On the other hand, the second positioning part 302 is formed in the vertical direction (upward direction of the device). The second positioning part 302 positions the transferring unit 15 in the height direction by engaging with the second post 154 (see FIG. 5) of the transferring unit 15.

Therefore, the positioning member 300 positions the transferring unit 15 simultaneously in the depth direction and the height direction by engaging the first positioning part 301 with the first post 153 (see FIG. 5) of the transferring unit 15 and by engaging the second positioning part 302 with the second post 154 (see FIG. 5) of the transferring unit 15, at the time of installing the transferring unit.

The main body side projection part 303 is a component which contacts a notched surface 400*c* (see FIG. 8A) of a handle side projection part 403 of the handle member 400 when the transferring unit 15 is removed from the printer 1. The main body side projection part 303 is placed on a notch part 405 (see FIG. 7) formed as an inner space of the notched surface 400*c* (see FIG. 8A) when the transferring unit 15 is installed to the printer 1. In addition, when the transferring unit 15 is removed from the printer 1, the main body side projection part 303 contacts the notched surface 400*c* (see FIG. 8A) of the handle side projection part 403 (see FIG. 7) and rotates the handle member 400 in the push-up direction centering about a post 155 (see FIG. 7). Thereby, the handle member 400 is automatically pushed out from the interior of the accommodation area 156. Here, the post 155 is provided inside the accommodation area 156 and is a component which becomes a fulcrum of the rotational motion of the handle member 400. Hereafter, the post 155 may be called "handle fulcrum 155" in some cases.

Next, the configuration of the transferring unit 15 is explained referring to FIGS. 5, and 6A-6C. As shown in FIG. 5, the transferring unit 15 has a configuration where the upper surface is the carrying surface of the main carrying path 8, and the lower surface is the carrying surface of the inversion carrying path 9. In addition, the transferring unit 15 includes the transferring roller 151, the first post 153, the second post 154, and springs 157 and 158.

As discussed above, the transferring roller 151 is a roller which functions as a transferring member that transfers the developer image to the medium as well as a carrying member that carries the medium. The transferring roller 151 is provided approximately in the center on the upper surface, which becomes the carrying surface of the main carrying path 8, so as to oppose the photosensitive drum 131 of the image forming unit 13.

The first post 153 is a component which positions the transferring unit 15 in the depth direction by engaging with the first positioning part 301 (see FIGS. 4 and 7) of the positioning member 300. The first post 153 is provided to project on both the right and left sides of the transferring unit 15 in a horizontal direction (in the direction of the shaft of the transferring roller 151) at a position on the downstream side of the transferring roller 151 and lower than the upper surface of the transferring unit 15. The first post 153 becomes the fulcrum (hereafter called "unit fulcrum") of the rotational motion of the transferring unit 15 when the transferring unit 15 is removed from the printer 1.

The second post 154 is a component which positions the transferring unit 15 in the height direction by engaging with the second positioning part 302 (see FIG. 4) of the positioning members 300. The second post 154 is provided to project on both the right and left sides of the transferring unit 15 in the vertical direction at a position on the upstream side of the transferring roller 151 and lower than the upper surface of the transferring roller 151.

The springs 157 and 158 are members which press the pinch rollers 123*b* and 124*b* toward the inversion carrying rollers 123*a* and 124*a* for producing a carrying force. The springs 157 and 158 each function as a biasing part which biases the transferring unit 15 in the push-up direction. The pinch rollers 123*b* and 124*b* have a configuration which enables an up-down motion within a preset range.

As shown in FIGS. 6A and 6B, the transferring unit 15 includes a pair of handle members 400 on both the right and left sides of the main carrying path 8. The handle members 400 are members which are grasped by a user when the user removes the transferring unit 15 from the printer 1. Although in the first embodiment, the handle members 400 are provided on both the right and left sides of the main carrying path 8, the handle members 400 may be provided above the main carrying path 8.

Here, as shown in FIG. 7, each handle member 400 includes a grip part 401, a hole 402, the handle-side projection part 403, and the notch 405. The grip part 401 is a part which is grasped by the user. In the grip part 401, the upper surface 400*a* shown in FIG. 8A becomes the part on which the user's hand is placed. The hole 402 is the part through which the user's fingers are inserted.

The handle side projection part 403 is the part formed projecting by being surrounded with the notched surface 400*c* and outer circumference surface 400*b* shown in FIG. 8A. When the transferring unit 15 is removed from the printer, the handle-side projection part 403 functions as a push-out mechanism which rotates the handle members 400 in the push-up direction centering on the handle fulcrum 155 by contacting the main-body-side projection part 303 on the notched surface 400*c*. The notch part 405 is the part where the main body side projection part 303 of the positioning member 300 is positioned when the transferring unit 15 is installed to the printer 1. The notch part 405 is a space formed inside the notched surface 400*c* (see FIG. 8A).

Here, the handle members 400 are configured as members each surrounded with an upper surface 400*a*, an outer circumference surface 400*b*, and the notched surface 400*c*. In addition, each handle member 400 has an opening 400*d*. The upper surface 400*a* is an approximately flat surface which is oriented approximately in the horizontal direction when the transferring unit 15 is installed in the printer 1. The outer circumference surface 400*b* is a surface formed in an approximate arc shape centering on the handle fulcrum 155 downwards from the outer edge of the upper surface 400*a*. The notched surface 400*c* is a surface formed curved downwards from the inner edge of the upper surface 400*a* as if submerging under the handle fulcrum 155. The opening 400*d* is a part which fits in the handle fulcrum 155.

As shown in FIGS. 6A and 6B, the transferring unit 15 includes the post 155 and the accommodation area 156 around each handle member 400 of the frame 15*a* of the transferring unit 15. The post 155 is a component which functions as a supporting part to support the handle member 400 in a freely-rotatable manner and which becomes the handle fulcrum (in other words, the fulcrum of the rotational motion of the handle member 400) as discussed above. The accommodation area 156 is a component which accommodates the handle member 400 in a manner allowing the handle member 400 to be freely inserted and removed so that the handle member 400 hides below the carrying surface of the main carrying path 8.

Therefore, the handle member 400 is supported by the handle fulcrum 155 of the transferring unit 15 in a freely rotatable manner and is accommodated inside the accommodation area 156 so as to hide below the carrying surface of the main carrying path 8 as shown in FIG. 6A. Thereby, the transferring unit 15 has a configuration which does not prevent miniaturization of the printer 1 while having the handle member 400. Moreover, because the handle member 400 has a configuration which allows the handle member 400 to be freely inserted and removed in and from the accommodation area 156, contacting the image forming unit 13 installed on the transferring unit 15 is possible. Therefore, the transferring unit 15 realizes the miniaturization of the printer 1 also by this aspect.

In addition, when the transferring unit 15 is removed from the printer 1, the handle member 400 projects outwardly from the accommodation area 156 so as to project above the carrying surface of the main carrying path 8 as shown in FIG. 6B. Thereby, the user can grasp the handle members 400.

Here, in the printer 1, when the transferring unit 15 is removed from the printer 1, the springs 157 and 158, which are biasing parts, rotate the transferring unit 15 in the push-up direction about the first post 153 which is the unit fulcrum. At that time, the main body side projection part 303 (see FIG. 7) contacts the notched surface 400*c* (see FIG. 8A) of the handle side projection part 403 (see FIG. 7) and rotates the handle member 400 in the push-up direction centering on the handle fulcrum 155. Therefore, the springs 157 and 158 which are biasing parts function as a push-out mechanism together with the first post 153 which is the unit fulcrum and the handle side projection part 403. As a result, when the image forming unit 13 is removed from the printer 1, the handle member 400 automatically projects outwardly from the interior of the accommodation area 156 of the transferring unit 15. Thereby, the printer 1 maintains visibility of the handle member 400 and easy gripping of the handle member 400.

As shown in FIG. 6C, the transferring unit 15 has pinch rollers 123*b* and 124*b*. The pinch rollers 123*b* and 124*b* are installed opposing the inversion carrying rollers 123*a* and 124*a* of the medium carrying mechanism 12 on the lower surface which becomes the carrying surface of the inversion carrying path 9.

Next, the configuration at the time of installing the transferring unit 15 is explained referring to FIG. 7. As shown in FIG. 7, first it is assumed that the user has installs the transferring unit 15 to the apparatus main body (medium carrying mechanism 12).

At this time, the first post 153 of the transferring unit 15 engages with the first positioning part 301 of the positioning member 300, and the second post 154 (see FIG. 4) engage with the second positioning part 302 (see FIG. 4) of the positioning member 300. However, because the springs 157 and 158 (see FIG. 8B) provided in the bottom surface side, the transferring unit 15 floats from a predetermined fixed position by the springs 157 and 158.

Next, it is assumed that the user has installed the image forming unit 13 on the transferring unit 15 in that state.

At this time, the image forming unit 13 presses down the transferring roller 151 of the transferring unit 15 from the top by the photosensitive drum 131. Therefore, the image forming unit 13 functions as a load member which applies a pressure to the transferring unit 15. Thereby, the springs 157 and 158 of the transferring unit 15 flex.

As a result, the transferring unit 15 has the first post 153 settle into a specified fixed position inside the first positioning part 301 of the positioning members 300 and the second post 154 (see FIG. 4) settle inside the second positioning part 302 (see FIG. 4) of the positioning members 300. Thereby, the transferring unit 15 is positioned to a specified fixed position.

In addition, at this time, the image forming unit 13 contacts with the upper surface of the handle members 400 and presses the handle members 400 from the top. Thereby, each handle member 400 rotates about the handle fulcrum 155 of the transferring unit 15 and is accommodated inside the accommodation area 156. Thereby, the handle member 400 hides under the main carrying path 8. At this time the handle side projection part 403 is placed under the main body side projection part 303 of the positioning member 300.

In addition, at this time, the image forming unit 13 is positioned in a freely-rotatable manner as the shaft part 131*a* of the photosensitive drum 131 engages with the projection 207*b* of the arm 207 of the spring 204.

Next, operation of the printer 1 at the time of removing the image forming unit 13 and the transferring unit 15 is explained referring to FIGS. 8A and 8B. Here, as shown in FIG. 7, it is assumed that the printer 1 includes the transferring unit 15 installed on the apparatus main body (medium carrying mechanism 12 (see FIG. 1)) and further the image forming unit 13 installed on the transferring unit 15. Each handle member 400 of the transferring unit 15 is in a state of being accommodated in the accommodation area 156. Then, it is assumed that in the printer 1, a jam has occurred to the medium being carried in the inversion carrying path 9. In this case, the user removes the image forming unit 13 and the transferring unit 15 from the printer 1 for performing a work to remove the jammed medium.

First, as shown in FIG. 8A, the user removes the image forming unit 13 from the specified fixed position regulated by the guide part 202 and the positioning parts 301 and 302 of the positioning member 300 by moving the image forming unit 13 in the direction of arrow A.

At this time, in the image forming unit 13, the shaft part 131*a* of the photosensitive drum 131 moves in the arrow A direction along the guide parts 202. Therefore, the spring 204 temporarily deforms in the direction of arrow B as the projection 207*b* of the arm 207 is pushed by the shaft part 131*a* of the photosensitive drum 131. As a result, the spring 204 is released from the engagement with the shaft part 131*a* of the photosensitive drum 131.

Once the spring 204 is released from the engagement with the shaft part 131*a* of the photosensitive drum 131, the projection 207*b* of the arm 207 returns to the original state as shown in FIG. 8B. At this time, the transferring unit 15 loses the pressure from the upper part (image forming unit 13). Therefore, the transferring unit 15 is released from the pressure of the springs 157 and 158 and is pushed up in the direction of arrow C as shown in FIG. 8B. At this time, because the first post 153 is engaged with the first positioning part 301 of the positioning member 300, the transferring unit 15 rotates in the direction of arrow D about the first post 153 by the pressure of the springs 157 and 158.

The handle member 400 has the handle-side projection part 403 placed below the main body side projection part 303 of the positioning member 300 in the state where the image forming unit 13 is installed. Once the image forming unit 13 is removed, the pressure of the springs 157 and 158 in the transferring unit 15 is released, and the springs 157 and 158 open. Accordingly, the transferring unit 15 rotates in the direction of the arrow D (see FIG. 8B) about the first post 153 which is the unit fulcrum. Therefore, the transferring unit 15 allows the notched surface 400*c* (see FIG. 8A) of the handle side projection part 403 of the handle member 400 to contact the main body side projection part 303 of the positioning member 300. Thereby, the handle member 400 rotates in the direction of arrow E about the handle fulcrum 155 of the transferring unit 15. As a result, when the image forming unit 13 is removed, the handle member 400 automatically projects outwardly from the interior of the accommodation area 156 of the transferring unit 15.

Next, the user grips the handle members 400 and lifts the transferring unit 15 to remove the transferring unit 15 from the specified fixed position regulated by the positioning member 300.

Afterwards, the user removes the jammed medium, and, once complete, installs the transferring unit 15 and the image forming unit 13 to the printer 1. Below, the operation for installing the transferring unit 15 and the image forming unit 13 to the printer 1 are explained referring to FIG. 8C.

First, as shown in FIG. 8C, the user installs the transferring unit 15 on the medium carrying mechanism 12. At this time, the user fits the first post 153 with the first positioning part 301 and fits the second post 154 (see FIG. 4) with the second positioning part 302 (see FIG. 4) to install the transferring unit 15 on the medium carrying mechanism 12.

Next, the user installs the image forming unit 13 on the transferring unit 15. The user installs the image forming unit 13 on the transferring unit 15 by fitting the shaft part 131*a* of the photosensitive drum 131 of the image forming unit 13 into the guide part 202 and by moving the image forming unit 13 along the guide parts 202 in the direction of arrow F.

At this time, the image forming unit 13 presses down the transferring unit 15 from the top as a load member. In that process, the bottom of the image forming unit 13 contacts the upper surface 400*a* of the handle member 400. Therefore, the handle member 400 rotates in the direction of arrow G about the handle fulcrum 155. As a result, the handle member 400 is accommodated inside the accommodation area 156 of the transferring unit 15.

In addition, at this time, the image forming unit 13 causes the photosensitive drum 131 to press down the transferring roller 151 of the transferring unit 15 from the top. Thereby, the springs 157 and 158 of the transferring unit 15 deform. As a result, the transferring unit 15 rotates in the direction of arrow I about the first post 153 while sinking in the direction of arrow H. Then, the first post 153 of the transferring unit 15 settles at the specified fixed position inside the first positioning part 301 of the positioning member 300, and the second post 154 (see FIG. 4) settles inside the second positioning part 302 (see FIG. 4) of the positioning member 300. Thereby, the transferring unit 15 is positioned at the specified fixed position.

The handle member 400 may be accommodated inside the accommodation area 156 of the transferring unit 15 also as the user pushes the handle member 400 in the direction of the arrow G during the time after installing the transferring unit 15 and before installing the image forming unit 13.

In the first embodiment, the printer 1 includes the handle member 400 installed below the image forming unit 13. This is because the printer 1 realizes the following operations (1) to (3), for example:

(1) The image forming unit 13 presses down the handle member 400 when the image forming unit 13 is installed. Thereby, the handle member 400 is automatically accommodated in the accommodation area 156 when the image forming unit 13 is installed. (2) The transferring unit 15 is installed in the apparatus main body so as to hide under the fuser unit 16. Therefore, the transferring unit 15 can be easily removed by providing the handle member 400 at a position away from the fuser unit 16. (3) The handle member 400 is made easily operated by providing the handle member 400 near the image forming unit 13 which is more frequently removed, rather than near the fuser unit 16 which is comparatively less frequently removed.

As discussed above, the transferring unit 15 of the first embodiment includes the handle member 400 that is accommodated inside the accommodation area 156, miniaturization of the printer 1 is not prevented, while providing the handle member 400. In addition, according to the transferring unit 15, because the handle member 400 automatically projects outwardly from the interior of the accommodation area 156 when the image forming unit 13 is removed, visibility of the handle member 400 and easy gripping of the handle member 400 is maintained. In addition, according to the printer 1 using the transferring unit 15 of the first embodiment, the transferring unit 15 is easily removed, and miniaturization of the device is realized. In addition, according to the printer 1, because the handle member 400 automatically projects outwardly from the interior of the accommodation area 156 when the image forming unit 13 is removed, visibility of the handle member 400 and easy gripping of the handle member 400 is maintained.

Second Embodiment

In the printer 1 of the first embodiment, even if the user installs the transferring unit 15 at the specified position, the user cannot feel the actual installation. Therefore, the printer 1 of the first embodiment may possibly cause the user to become anxious when the transferring unit 15 is installed.

Therefore, a printer 1A of a second embodiment (see FIG. 12A) allows the user to feel the actual installation when the user installs a transferring unit 15A of the second embodiment at a specified position. Thereby, the printer 1A of the second embodiment prevents the user from becoming anxious when installing the transferring unit 15A.

Figure 9:
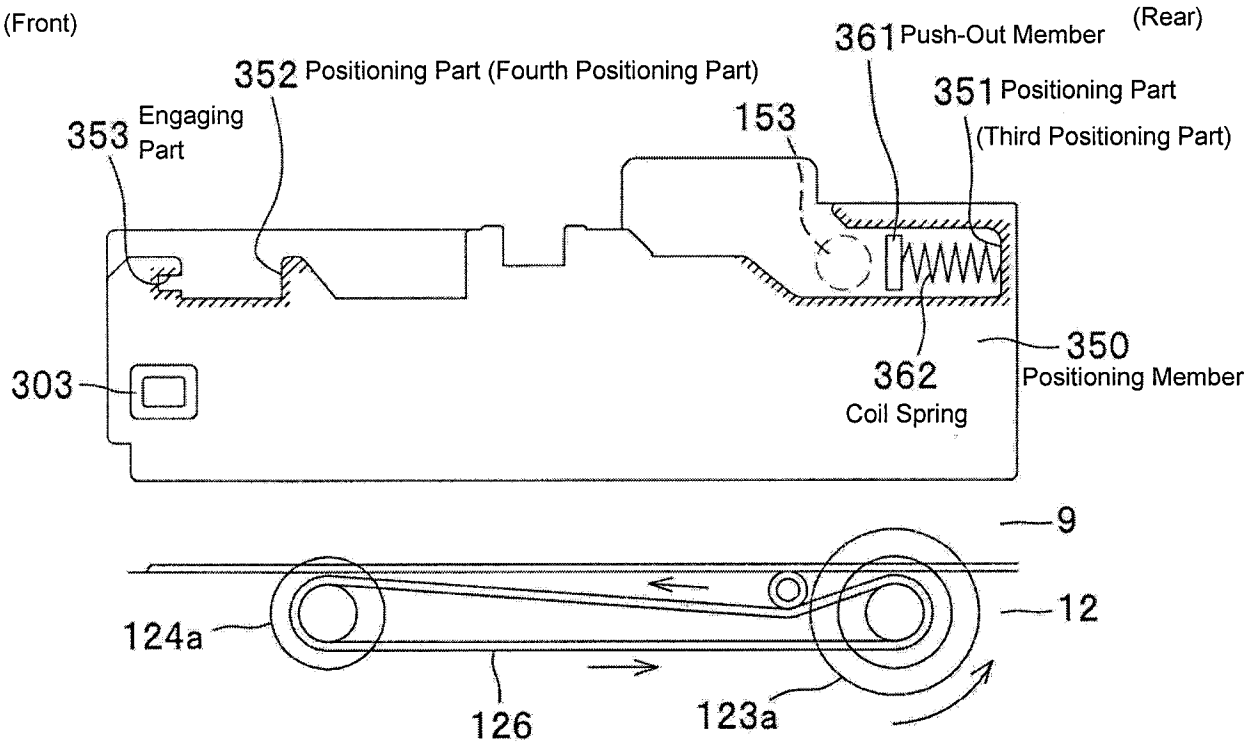
FIG. 9 is a figure showing a peripheral configuration of a medium carrying unit of a second embodiment.
Figure 10:
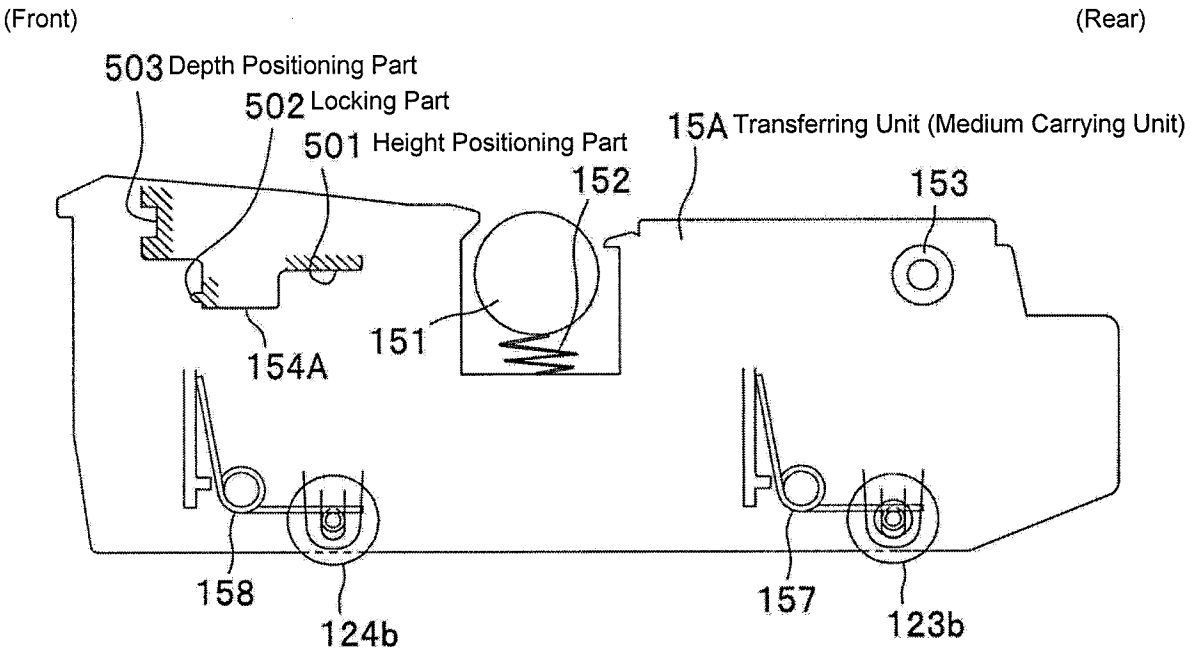
FIG. 10 is a figure showing the configuration of the medium carrying unit of the second embodiment.
Figure 11:
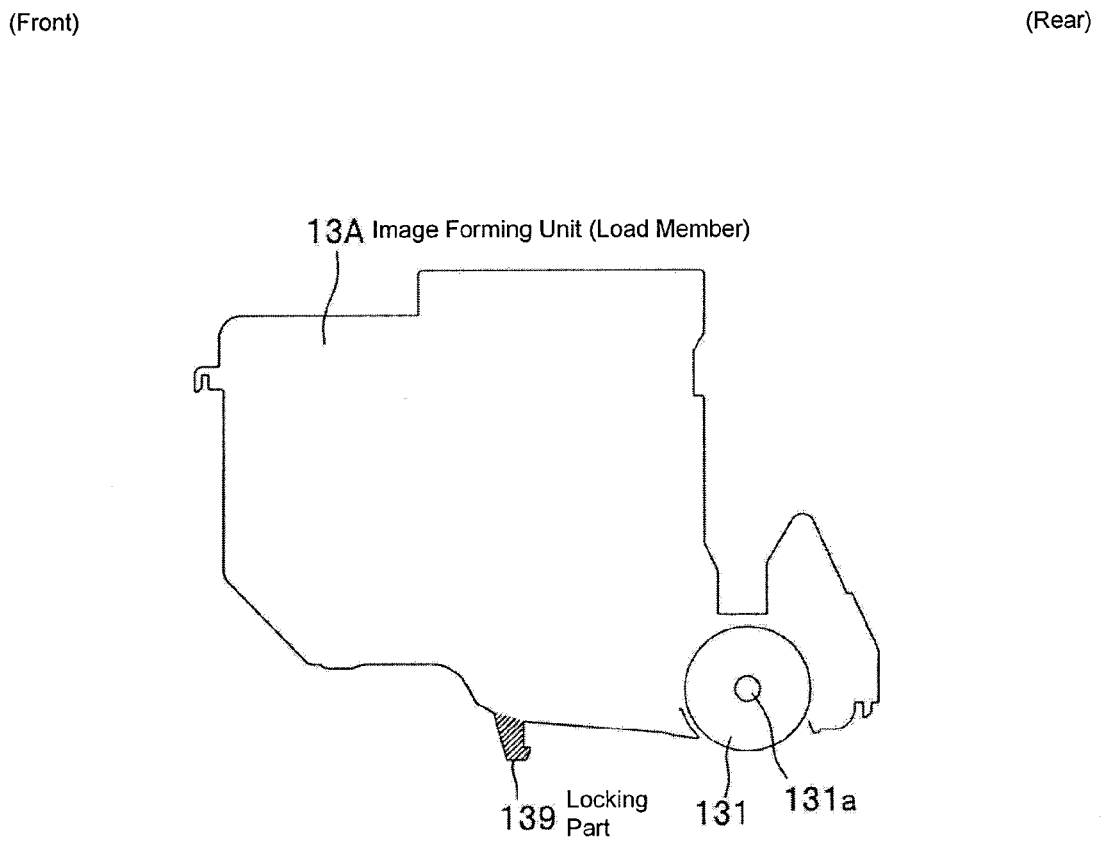
FIG. 11 is a figure showing the configuration of a load member of the second embodiment.

Below, the configuration of the printer 1A (see FIG. 12A) of the second embodiment is explained referring to FIGS. 9-11. FIG. 9 is a figure showing a peripheral configuration of a medium carrying unit of the second embodiment. FIG. 9 shows the configuration of a positioning member 350 of the second embodiment. FIG. 10 is a figure showing the configuration of the medium carrying unit of the second embodiment. FIG. 10 shows the configuration of the transferring unit 15A of the second embodiment. FIG. 11 is a figure showing the configuration of a load member of the second embodiment. FIG. 11 shows the configuration of an image forming unit 13A of the second embodiment. The other configurations are the same as the configuration of the printer 1 of the first embodiment. Therefore, detailed explanation of such configurations is omitted.

As shown in FIG. 9, in comparison with the positioning member 300 (see FIG. 4) of the first embodiment, the positioning member 350 of the second embodiment is different in including a third positioning part 351 instead of the first positioning part 301 and a fourth positioning part 352 instead of the second positioning part 302.

Similar to the first positioning part 301 of the positioning member 300 (see FIG. 4) of the first embodiment, the third positioning part 351 is a groove which engages with the first post 153 that is provided on the transferring unit 15A (see FIG. 10) and that projects in a lateral direction (the right-left direction of the transferring unit 15A). The third positioning part 351 is formed so that an opening faces an oblique rear direction of the printer 1A and further a bottom faces the rear direction of the printer 1A. The third positioning part 351 positions the transferring unit 15A in the depth direction (rear direction of the device) by engaging with the first post 153 of the transferring unit 15A.

However, unlike the first positioning part 301, the third positioning part 351 includes a push-out member 361 and a coil spring (hereafter, simply called "spring") 362 that are provided inside the third positioning part 351. The push-out member 361 is a member which contacts the first post 153. The spring 362 is a member which biases the first post 153 toward the front direction together with the push-out member 361. In addition, the third positioning part 351 is formed so that a bottom length is longer than the positioning part 301 by an amount of the push-out member 361 and the spring 362 provided therein.

Similar to the second positioning part 301 of the positioning member 300 (see FIG. 4) of the first embodiment, the fourth positioning part 352 is a groove which engages with a second post 154A (see FIG. 10) that is provided on the transferring unit and that projects downwardly.

The fourth positioning part 352 is formed in the vertical direction. The fourth positioning part 352 positions the transferring unit 15 in the height direction by engaging with the second post 154A of the transferring unit 15A.

Here, unlike the second positioning part 302, the fourth positioning part 352 includes an engaging part 353 provided therein. An engaging part 353 is a groove which temporarily engages with a locking part 502 (see FIG. 10) provided on the second post 154A. The engaging part 353 is provided on the inner wall in the front direction of the fourth positioning part 352 so as to distant away from the third positioning part 351.

As shown in FIG. 10, comparing with the transferring unit 15 (see FIG. 5) of the first embodiment, the transferring unit 15A of the second embodiment is different in that the transferring unit 15A includes the second post 154A in place of the second post 154 and also includes a height positioning part 501 and a depth positioning part 503.

The second post 154A is a post including the locking part 502. The locking part 502 is a projection which temporarily engages with the engaging part 353 provided on the fourth positioning part 352 of the positioning member 350 (see FIG. 9). The locking part 502 is provided on the outer wall surface in the front direction of the second post 154A so as to distant away from the first post 153.

The height positioning part 501 is a part for positioning the transferring unit 15A in the height direction. The height positioning part 501 is constructed as an approximately flat surface around the second post 154A.

The depth positioning part 503 is a part for positioning the transferring unit 15A in the depth direction. The depth positioning part 503 is a groove which engages with a locking part 139 (see FIG. 11) provided in the lower surface side of the image forming unit 13A (see FIG. 11) of this the second embodiment.

When the transferring unit 15A is installed, a pair of the first posts 153 provided on both the right and left sides are fitted in the third positioning part 351 of the positioning member 350 (see FIG. 9) and contact with the push-out member 361. Then, the spring 362, together with the push-out member 361, biases the first post 153 in the front direction.

In addition, when the transferring unit 15A is installed, a pair of the second posts 154A provided on the right and left sides is fitted in the fourth positioning part 352 of the positioning member 350 (see FIG. 9). At this time, the transferring unit 15A is positioned in the height direction as the height positioning part 501 contacts the periphery of the fourth positioning part 352 of the positioning member 350 (see FIG. 9). In addition, in the transferring unit 15A, the locking part 502 is fitted in the engaging part 353 of the positioning member 350 (see FIG. 9) and temporarily engage with the engaging part 353 as the sprint 362 biases the first post 153 in the forward direction.

Here, FIG. 10 does not show the handle fulcrum 155 or the accommodation area 156 for clarifying the differences between the transferring unit 15 of the first embodiment and the transferring unit 15A of the second embodiment. However, in actuality, the transferring unit 15A includes a pair of the handle fulcrum 155 and the accommodation area 156 provided on each of the right and left sides of the transferring unit 15A similar to the transferring unit 15 of the first embodiment. Then, the handle member 400 is attached to the handle fulcrum 155.

As shown in FIG. 11, in comparison with the image forming unit 13 (see FIG. 7) of the first embodiment, the image forming unit 13A of this the second embodiment is different in including the locking part 139.

The locking part 139 is a projection which engages with the depth positioning part 503 provided on the transferring unit 15A (see FIG. 10). The locking part 139 is provided in the lower surface side of the image forming unit 13A (see FIG. 11), and the front end of the locking part 139 has a hook shape. The locking part 139 performs the final positioning of the transferring unit 15A in the depth direction by engaging with the depth positioning part 503 provided on the transferring unit 15A (see FIG. 10).

Figure 12A:
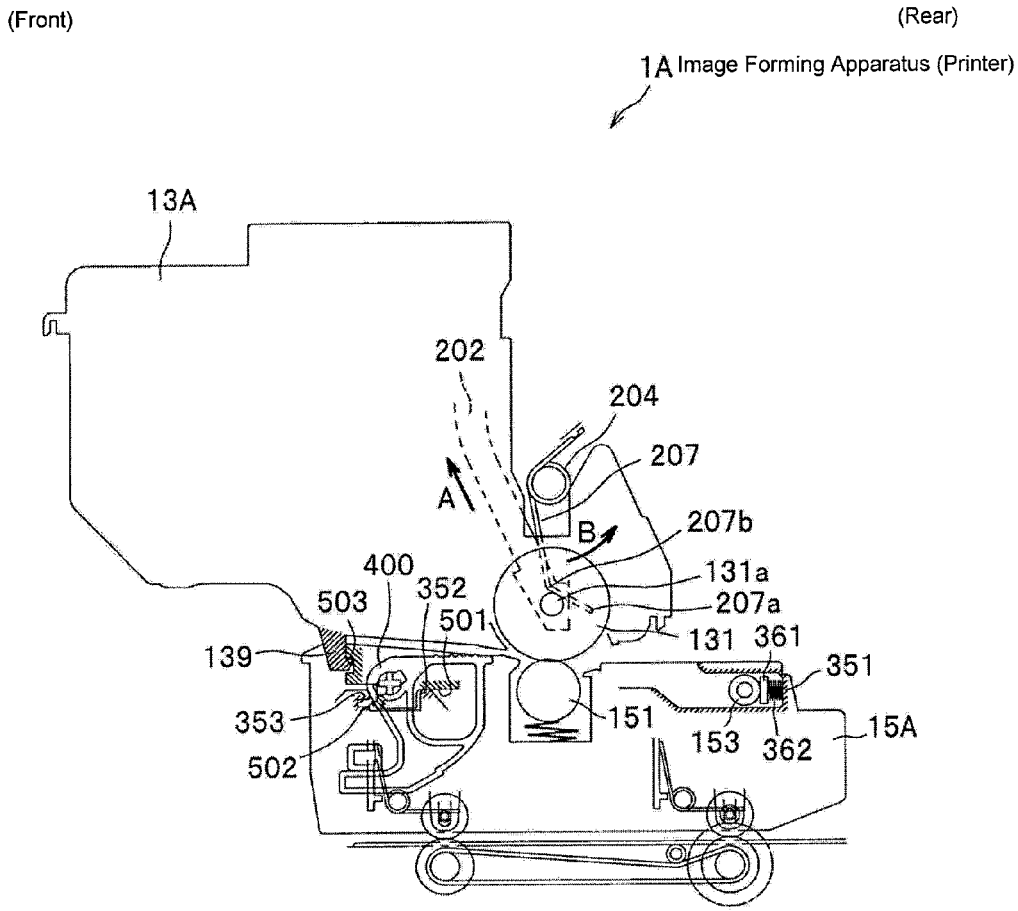
FIG. 12A is a first figure showing operation at the time of removing the medium carrying unit of the second embodiment.
Figure 12B:
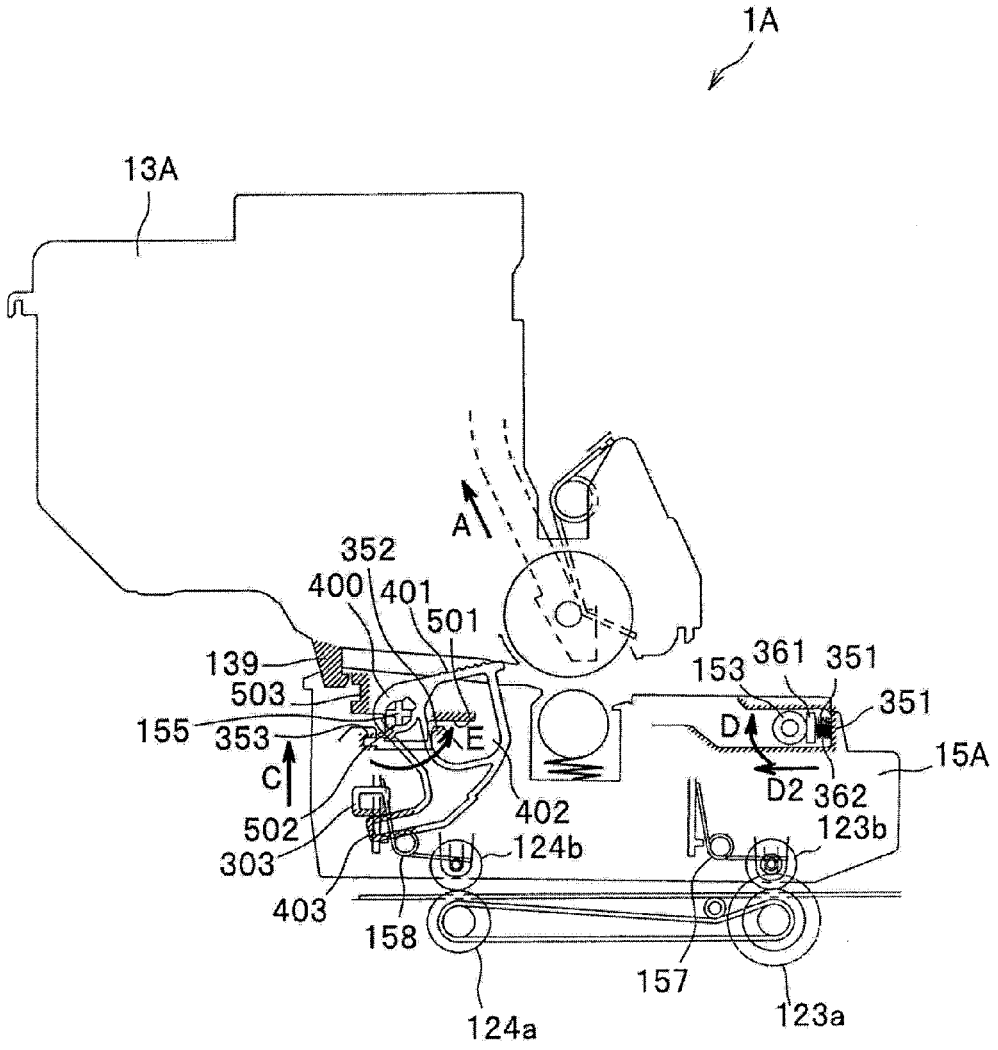
FIG. 12B is a second figure showing the operation at the time of removing of the medium carrying unit of the second embodiment.

Below, operation of the printer 1A of the second embodiment is explained referring to FIGS. 12A, 12B, and 13A-13D. FIGS. 12A and 12B are figures each showing operation at the time of removing the medium carrying unit of the second embodiment. FIGS. 13A-13D are figures each showing operation at the time of installing the medium carrying unit of the second embodiment.

First, operation of the printer 1A at the time of removing the image forming unit 13A and the transferring unit 15A is explained referring to FIGS. 12A and 12B. Here, as shown in FIG. 12A, it is assumed that the transferring unit 15A is installed on the apparatus main body (medium carrying mechanism (see FIG. 1)), and the image forming unit 13A is installed on the transferring unit 15A. Here, the handle member 400 of the transferring unit 15A is in a state of being accommodated in the accommodation area 156. Then, it is assumed that the printer 1A had jamming occurred to the medium in the inversion carrying path 9. In this case, the user removes the image forming unit 13A and the transferring unit 15A from the printer 1A for performing a work to remove the jammed medium.

First, as shown in FIG. 12A, the user removes the image forming unit 13A from the specified fixed position regulated by the guide parts 202 and the positioning parts 351 and 352 of the positioning member 350 by moving the image forming unit 13A in the direction of arrow A.

At this time, in the image forming unit 13A, the shaft part 131*a* of the photosensitive drum 131 moves in the direction of the arrow A along the guide parts 202. Therefore, the spring 204 temporarily deforms in the direction of arrow B as the projection 207*b* of the arm 207 is pushed by the shaft part 131*a* of the photosensitive drum 131. As a result, the spring 204 is released from its engagement with the shaft part 131*a* of the photosensitive drum 131.

Once the spring 204 is released from the engagement with the shaft part 131*a* of the photosensitive drum 131, the projection 207*b* of the arm 207 returns to the original state as shown in FIG. 12B. At this time, the transferring unit 15A loses the pressure from the upper part (image forming unit 13). Therefore, the transferring unit 15A is released from the pressure of the springs 157 and 158 and is pushed up in the direction of arrow C as shown in FIG. 12B. At this time, because the first post 153 is engaged with the third positioning part 351 of the positioning member 350, the transferring unit 15A rotates in the direction of arrow D about the first post 153 by the pressure of the springs 157 and 158. At the same time, the spring 362, together with the push-out member 361, pushes out the first post 153 by a restoring force in the direction of arrow D2.

The handle member 400 has the handle-side projection part 403 placed below the main body side projection part 303 of the positioning member 350 in the state where the image forming unit 13A is installed. Once the image forming unit 13A is removed, the pressure of the springs 157 and 158 in the transferring unit 15A is released, and the springs 157 and 158 open. Accordingly, the transferring unit 15A rotates in the direction of the arrow D (see FIG. 12B) about the first post 153 which is the unit fulcrum. Therefore, the transferring unit 15A allows the notched surface 400*c* (see FIG. 8A) of the handle side projection part 403 of the handle member 400 to contact the main body side projection part 303 of the positioning member 350. Thereby, the handle member 400 rotates in the direction of arrow E about the handle fulcrum 155 of the transferring unit 15A. As a result, when the image forming unit 13A is removed, the handle member 400 automatically projects outwardly from the interior of the accommodation area 156 of the transferring unit 15A.

Next, the user grips the handle members 400 and lifts the transferring unit 15A to remove the transferring unit 15A from the specified fixed position regulated by the positioning members 350

Afterwards, the user performs a work to remove the jammed medium, and once the removal work is complete, installs the transferring unit 15A and the image forming unit 13A to the printer 1A. Below, the operation for installing the transferring unit 15A and the image forming unit 13A to the printer 1A are explained referring to FIGS. 13A-13D.

Figure 13A:
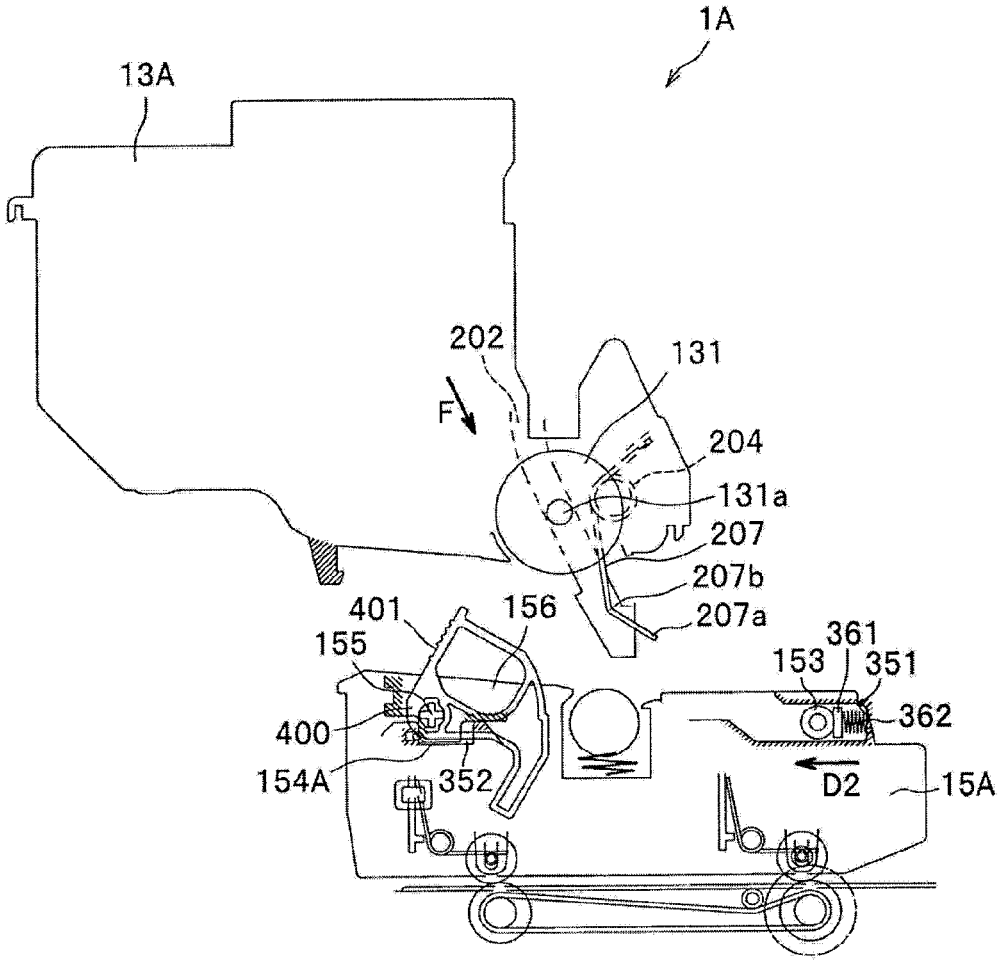
FIG. 13A is a first figure showing operation at the time of installing the medium carrying unit of the second embodiment.

First, as shown in FIG. 13A, the user installs the transferring unit 15A on the medium carrying mechanism 12. At this time, the user fits the first post 153 with the third positioning part 351 and fits the second post 154 with the fourth positioning part 352 to install the transferring unit 15A on the medium carrying mechanism 12.

At this time, the second post 154A causes the locking part 502 to engage with the engaging part 353 of the fourth positioning part 352 of the positioning member 350. The engaging force is obtained from the restoring force of the spring 362 generated in the direction of arrow D2. As a result, the transferring unit 15A comes into a state of being temporarily engaged with the apparatus main body.

When the locking part 502 and the engaging part 353 engage with each other, a sound is generated, and the transferring unit 15A is fixed to the apparatus main body more strongly than the transferring unit 15 of the first embodiment by the engagement of the locking part 502 and the engaging part 353. Therefore, the user can obtain a sense that the transferring unit 15 is installed. Thereby, the printer 1A of the second embodiment prevents the user from become anxious when the transferring unit 15A is installed.

Figure 13B:
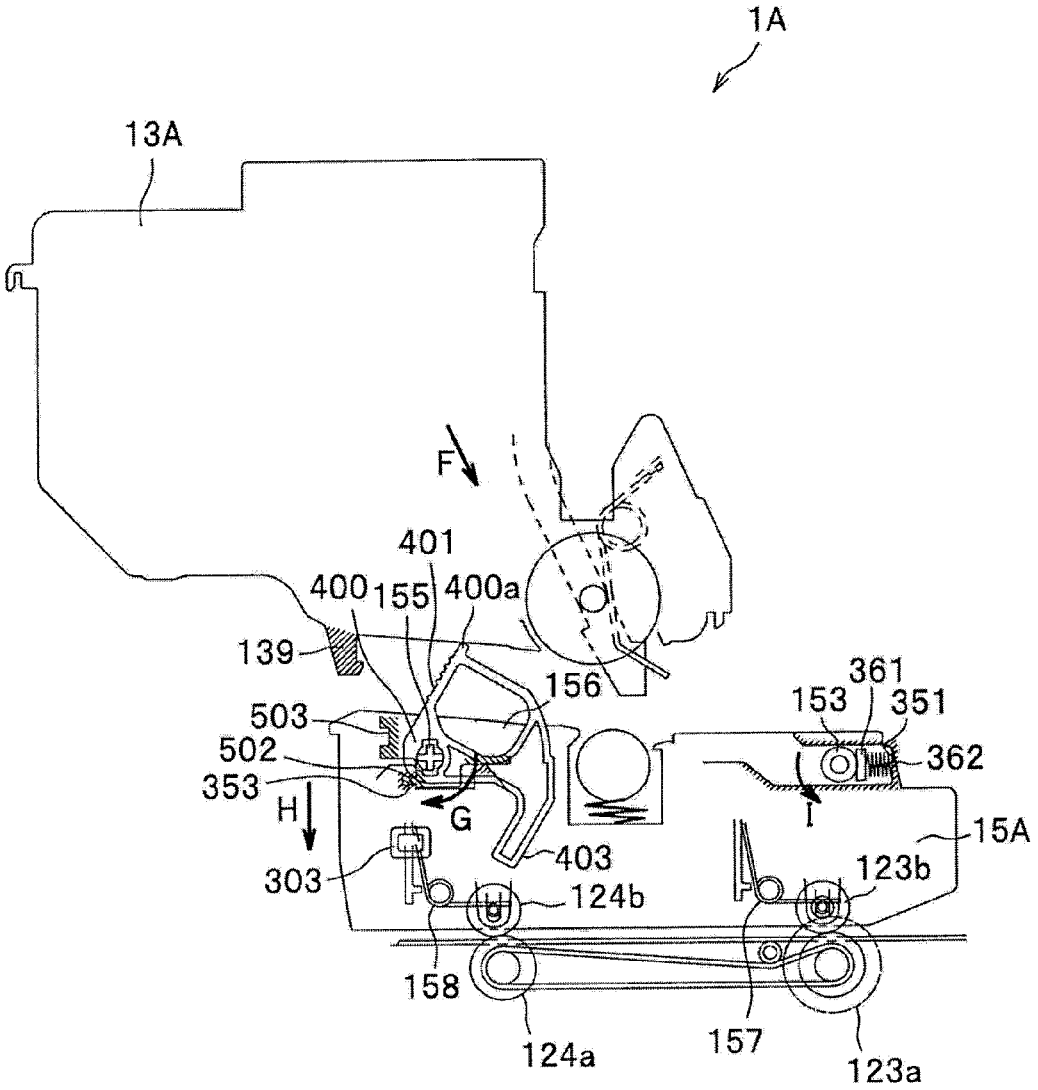
FIG. 13B is a second figure showing the operation at the time of installing the medium carrying unit of the second embodiment.

Next, as shown in FIG. 13B, the user installs the image forming unit 13A on the transferring unit 15A. The user installs the image forming unit 13A on the transferring unit 15A by fitting the shaft part 131*a* of the photosensitive drum 131 of the image forming unit 13A into the guide parts 202 and by moving the image forming unit 13A along the guide parts 202 in the direction of arrow F.

At this time, the image forming unit 13A presses down the transferring unit 15A from the top as a load member. In that process the bottom of the image forming unit 13A contacts the upper surface 400*a* of the handle member 400. Therefore, the handle member 400 rotates in the direction of arrow G about the handle fulcrum 155. As a result, the handle member 400 is accommodated inside the accommodation area 156 of the transferring unit 15A.

In addition, at this time the image forming unit 13A causes the photosensitive drum 131 to press down the transferring roller 151 of the transferring unit 15A from the top. Thereby, the springs 157 and 158 of the transferring unit 15A deform. As a result, the transferring unit 15 rotates in the direction of arrow I about the first post 153 while sinking in the direction of arrow H. Then, the first post 153 of the transferring unit 15A settles at the specified fixed position inside the third positioning part 351 of the positioning member 350, and the second post 154A (see FIG. 13A) settles inside the fourth positioning part 352 (see FIG. 13A) of the positioning member 350. Thereby, the transferring unit 15A is positioned to the specified fixed position.

Figure 13C:
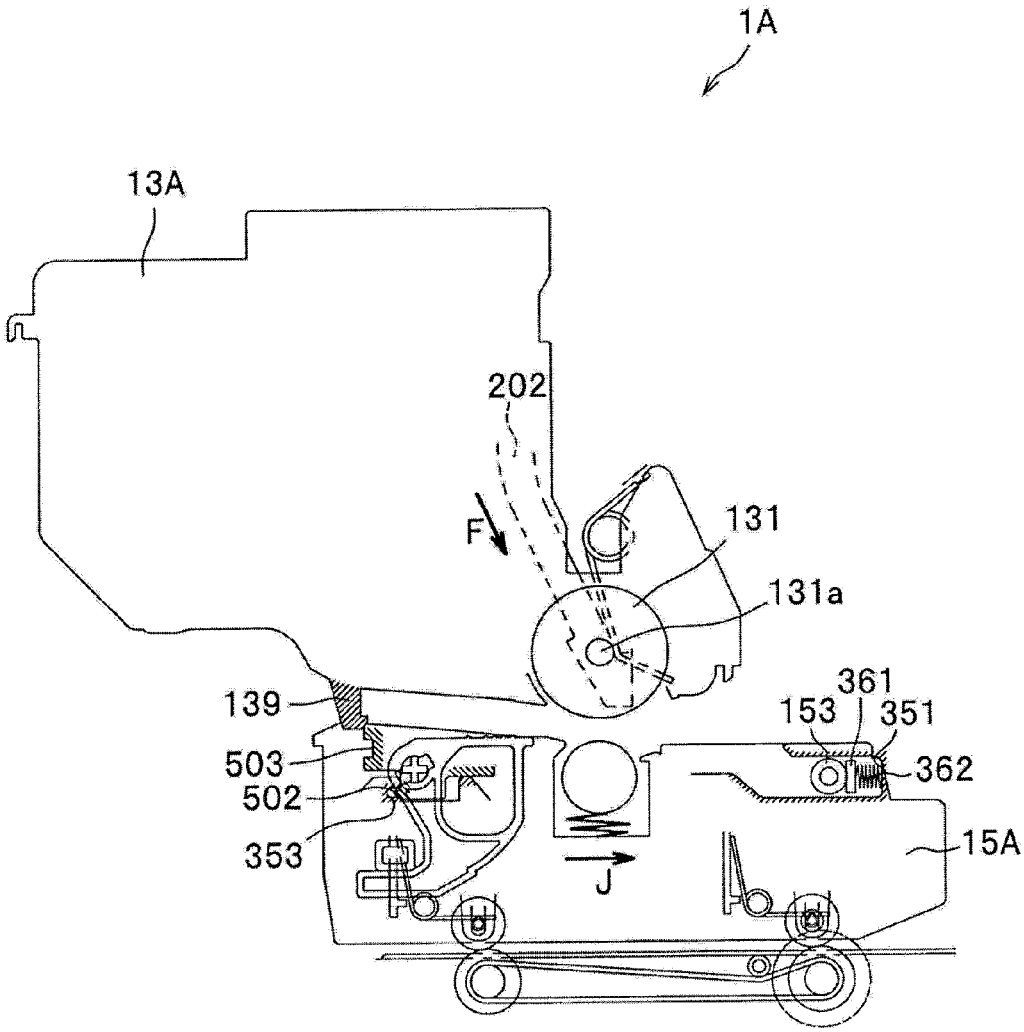
FIG. 13C is a third figure showing the operation at the time of installing the medium carrying unit of the second embodiment.

At this time, as shown in FIG. 13C, as the image forming unit 13A moves in the direction of arrow F, the locking part 139 presses the transforming unit 15A in the direction of arrow J. Because the first post 153 is guided by the third positioning part 351, the transforming unit 15A moves in the direction of the arrow J.

In the transferring unit 15A, when the first post 153 moves further in the direction of the arrow J while compressing the sprint 362 via the push-out member 361, the locking part 502, which has been temporarily engaged with the engaging part 353, is released from the engagement with the engaging part 353.

Figure 13D:
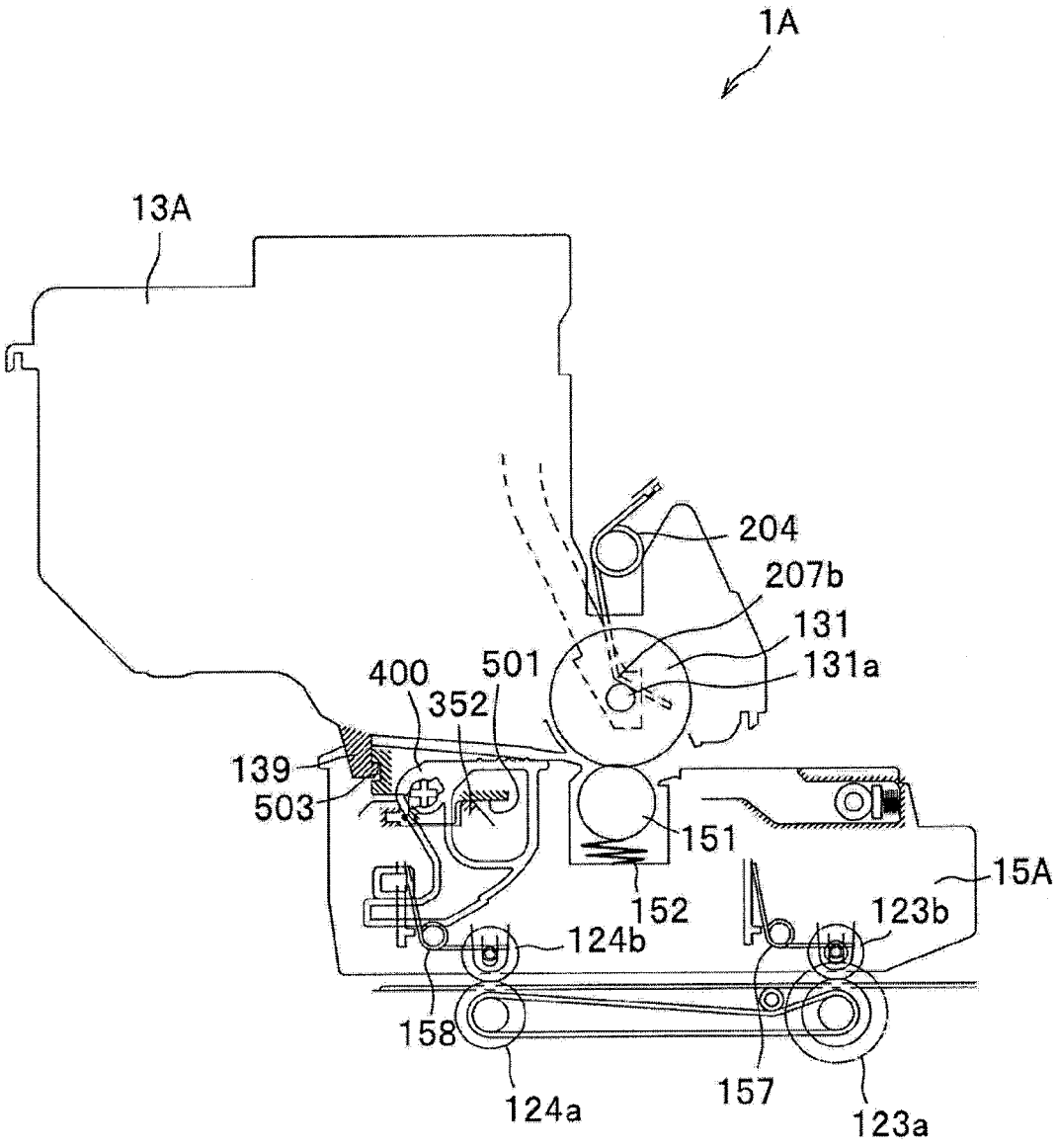
FIG. 13D is a fourth figure showing the operation at the time of installing the medium carrying unit of the second embodiment.

Then, as shown in FIG. 13D, the transferring unit 15A eventually causes the depth positioning part 503 to engage with the locking part 139 of the image forming unit 13A. At this time, the image forming unit 13A causes the shaft part 131*a* of the photosensitive drum 131 to be locked by the projection 207*b* of the spring 204. In addition, the transferring unit 15A is positioned in the height direction as the height positioning part 501 contacts the upper surface of the positioning member 350.

The handle member 400 may be accommodated inside the accommodation area 156 of the transferring unit 15A also as the user pushes handle member 400 in the direction of the arrow G during the time after installing the transferring unit 15A and before installing the image forming unit 13A.

As discussed above, according to the printer 1A of the second embodiment, similar to the printer 1 of the first embodiment, the transferring unit 15A is easily removed, and miniaturization of the device is realized. In addition, according to the printer 1A, similar to the printer 1 of the first embodiment, because the handle member 400 automatically projects outwardly from the interior of the accommodation area 156 when the image forming unit 13 is removed, visibility of the handle member 400 and easy gripping of the handle member 400 are maintained. Moreover, according to the printer 1A, because the locking part 502 temporarily engages with the engaging part 353 of the fourth positioning part 352 of the positioning member 350 when the transferring unit 15A is installed, a sense that the transferring unit 15 has been installed is given to the user.

In addition, according to the printer 1A, because the final positioning of the transferring unit 15A is performed by the engagement of the locking part 139 and the engaging part 503, the distance between the carrying surface of the image forming unit 13A side and the carrying surface of the transferring unit 15A side of the main carrying path 8 is made to a specified distance. As a result, according to the printer 1A, because the medium is stably carried to a nip part between the photosensitive drum 131 and the transferring roller 151, the occurrence of jamming is reduced.

The present embodiments are not limited to the above-described configurations. However, various modifications may be made within a scope which does not deviate from the main object of the present application. For example, although an LED electrographic printer is used in the explanation of the first and second embodiments, the image forming apparatus 1 may be a laser electrographic printer. In addition, the image forming apparatus 1 may be an intermediate transfer type electrographic printer. Moreover, the image forming apparatus 1 may be a tandem color printer. Further, the present embodiments may be used for not only printers but also other image forming apparatuses, such as facsimile machines, copiers, MFPs and the like, for example. Furthermore, the printer 1 and 1A perform the depth-direction positioning and height-direction positioning by different positioning parts 301 and 302 (or 351 and 352), for example. However, the printer 1 and 1A may include a configuration that the depth-direction positioning and the height-direction positioning are simultaneously performed.

What is claimed is:

1. A medium carrying unit to be installed in an image forming apparatus, comprising:

a first carrying path through which a medium is carried;

a handle member positioned on or below the first carrying path and including a part to be gripped by a user in a state that allows the handle member to project above a carrying surface of the first carrying path;

an accommodation area that is defined to surround the handle member and that accommodates that handle member in a state that allows the handle member to be freely inserted and removed so that the handle member hides below the carrying surface of the first carrying path; and a push-out mechanism that pushes out the handle member from an interior of the accommodation area for removing the medium carrying unit from the image forming apparatus, wherein the handle member includes a handle fulcrum for enabling a rotational motion, the handle member being accommodated in the accommodation area by rotating the handle member about the handle fulcrum when the medium carrying unit is installed to the image forming apparatus, the handle member includes a handle side projection part that comprises the push-out mechanism to rotate the handle member in a push-up direction about the handle fulcrum by contacting a main body side projection part provided on the image forming apparatus when the medium carrying unit is removed from the image forming apparatus.

2. The medium carrying unit according to claim 1, wherein the handle member is configured as a member surrounded by an approximately flat upper surface that provides the handle fulcrum therein, and that is oriented in a direction approximately parallel with a top surface of the medium carrying unit when the medium carrying unit is installed to the image forming apparatus, an outer circumference surface formed in an approximate arc shape about the handle fulcrum downwardly from an outer edge of the upper surface so as to submerge under the handle fulcrum, and a notched surface that is downwardly curved from an inner edge of the upper surface and under the handle fulcrum, the handle member provides a notch part formed as an inner space of the notched surface, and the handle side projection part formed in a projecting shape by the outer circumference and the notched surface, the main body side projection part that is provided on the image forming apparatus is positioned inside the notch part when the medium carrying unit is installed to the image forming apparatus, and the handle side projection part is configured as the push-out mechanism which rotates the handle member in the push-up direction by contacting the main body side projection part at the notched surface when the medium carrying unit is removed from the image forming apparatus.

3. The medium carrying unit according to claim 2, further comprising:

a unit fulcrum that is provided at a position away from the handle fulcrum and that forms a fulcrum for rotation of the medium carrying unit; and a biasing part that biases the medium carrying unit in the push-up direction, wherein when the medium carrying unit is removed from the image forming apparatus, the biasing part functions as the push-out mechanism together with the unit fulcrum and the handle side projection part by causing the medium carrying unit to rotate in the push-up direction about the unit fulcrum, and by causing the handle-side projection part and the main body side projection part to contact each other in the notched surface of the handle side projection part and to rotate the handle member in the push-up direction about the handle fulcrum.

4. The medium carrying unit according to claim 3, wherein a load member is installed on a top of the medium carrying unit to apply a pressure that is stronger than the bias of the biasing part from the top of the medium carrying unit in a push-down direction when the medium carrying unit is installed in the image forming apparatus, the load member being removed from the top when the medium carrying unit is removed from the image forming apparatus, and the push-out mechanism operates when the load member is removed from the top of the medium carrying unit.

5. The medium carrying unit according to claim 2, wherein the handle member further includes:

a hole which is formed below the upper surface and which allows the user's finger to be inserted, and a grip which is configured by the upper surface and the hole and that allows the user to grip.

6. The medium carrying unit according to claim 1, wherein the handle member comprises at least two handle members provided on right and left sides of the first carrying path, respectively.

7. The medium carrying unit according to claim 4, wherein the load member is an image forming unit that includes an image carrier, on the surface of which a developer image is formed.

8. A medium carrying unit to be installed in an image forming apparatus, comprising:

a first carrying path through which a medium is carried;

a handle member positioned on or below the first carrying path and including a part to be gripped by a user in a state that allows the handle member to project above a carrying surface of the first carrying path;

an accommodation area that is defined to surround the handle member and that accommodates the handle member in a state that allows the handle member to be freely inserted and removed so that the handle member hides below the carrying surface of the first carrying path;

a push-out mechanism that pushes out the handle member from an interior of the accommodation area for removing the medium carrying unit from the image forming apparatus; and a locking part that temporarily fixes the medium carrying unit by engaging with an engaging part provided on the image forming apparatus side when the medium carrying unit is installed in the image forming apparatus.

9. A medium carrying unit to be installed in an image forming apparatus, comprising:

a first carrying path through which a medium is carried;

a handle member positioned on or below the first carrying path and including a part to be gripped by a user in a state that allows the handle member to project above a carrying surface of the first carrying path;

an accommodation area that is defined to surround the handle member and that accommodates the handle member in a state that allows the handle member to be freely inserted and removed so that the handle member hides below the carrying surface of the first carrying path;

a push-out mechanism that pushes out the handle member from an interior of the accommodation area for removing the medium carrying unit from the image forming apparatus; and a positioning part that positions the medium carrying unit in a depth direction by engaging with a projecting locking part provided on a load member when the load member is installed on the medium carrying unit.

10. A medium carrying unit to be installed in an image forming apparatus, comprising:

a first carrying path through which a medium is carried;

a handle member positioned on or below the first carrying path and including a part to be gripped by a user in a state that allows the handle member to project above a carrying surface of the first carrying path;

an accommodation area that is defined to surround the handle member and that accommodates the handle member in a state that allows the handle member to be freely inserted and removed so that the handle member hides below the carrying surface of the first carrying path;

a push-out mechanism that pushes out the handle member from an interior of the accommodation area for removing the medium carrying unit from the image forming apparatus; and a second carrying path which is separate from the first carrying path and to which the handle member is not provided.

11. An image forming apparatus in which a medium carrying unit that carries a medium for printing is installed in a freely detachable manner, the image forming apparatus, comprising:

a medium carrying unit, including:

a first carrying path through which the medium is carried;

a handle member positioned on or below the first carrying path and including a part to be gripped by a user in a state that allows the handle member to project above a carrying surface of the first carrying path;

an accommodation area that is defined to surround the handle member and that accommodates the handle member in a state that allows the handle member to be freely inserted and removed so that the handle member hides below the carrying surface of the first carrying path; and a push-out mechanism that pushes out the handle member from an interior of the accommodation area for removing the medium carrying unit form the image forming apparatus; and a main body side projection part that contacts the handle member of the medium carrying unit when the medium carrying unit is removed from the image forming apparatus, wherein the medium carrying unit comprises a transferring unit for transferring a developer image formed on s surface of an image carrier provided in the image forming apparatus to the medium.

12. The image forming apparatus according to claim 11, further comprising:

a positioning member that positions the medium carrying unit at a specified position.

13. The medium carrying unit according to claim 11, wherein the handle member includes a handle fulcrum for enabling a rotational motion, the handle member being accommodated in the accommodation area by rotating the handle member about the handle fulcrum when the medium carrying unit is installed to the image forming apparatus.

14. The medium carrying unit according to claim 13, wherein the handle member includes a handle side projection part that comprises the push-out mechanism to rotate the handle member in a push-up direction about the handle fulcrum by contacting a main body side projection part provided on the image forming apparatus when the medium carrying unit is removed from the image forming apparatus.

15. The medium carrying unit according to claim 14, wherein the handle member is configured as a member surrounded by an approximately flat upper surface that provides the handle fulcrum therein, and that is oriented in a direction approximately parallel with a top surface of the medium carrying unit when the medium carrying unit is installed to the image forming apparatus, an outer circumference surface formed in an approximate arc shape about the handle fulcrum downwardly from an outer edge of the upper surface so as to submerge under the handle fulcrum, and a notched surface that is downwardly curved from an inner edge of the upper surface and under the handle fulcrum, the handle member provides a notch part formed as an inner space of the notched surface, and the handle side projection part formed in a projecting shape by the outer circumference and the notched surface, the main body side projection part that is provided on the image forming apparatus is positioned inside the notch part when the medium carrying unit is installed to the image forming apparatus, and the handle side projection part is configured as the push-out mechanism which rotates the handle member in the push-up direction by contacting the main body side projection part at the notched surface when the medium carrying unit is removed from the image forming apparatus.

16. The medium carrying unit according to claim 15, further comprising:

a unit fulcrum that is provided at a position away from the handle fulcrum and that forms a fulcrum for rotation of the medium carrying unit; and a biasing part that biases the medium carrying unit in the push-up direction, wherein when the medium carrying unit is removed from the image forming apparatus, the biasing part functions as the push-out mechanism together with the unit fulcrum and the handle side projection part by causing the medium carrying unit to rotate in the push-up direction about the unit fulcrum, and by causing the handle-side projection part and the main body side projection part to contact each other in the notched surface of the handle side projection part and to rotate the handle member in the push-up direction about the handle fulcrum.

17. The medium carrying unit according to claim 16, wherein a load member is installed on a top of the medium carrying unit to apply a pressure that is stronger than the bias of the biasing part from the top of the medium carrying unit in a push-down direction when the medium carrying unit is installed in the image forming apparatus, the load member being removed from the top when the medium carrying unit is removed from the image forming apparatus, and the push-out mechanism operates when the load member is removed from the top of the medium carrying unit.

18. The medium carrying unit according to claim 15, wherein the handle member further includes:

a hole which is formed below the upper surface and which allows the user's finger to be inserted, and a grip which is configured by the upper surface and the hole and that allows the user to grip.

19. The medium carrying unit according to claim 11, wherein the handle member comprises at least two handle members provided on right and left sides of the first carrying path, respectively.

20. The medium carrying unit according to claim 17, wherein the load member is an image forming unit that includes an image carrier, on the surface of which a developer image is formed.

21. A medium carrying unit to be installed in an image forming apparatus, comprising:

a housing including a first side, a second side that opposes the first side and a side surface between the first and second sides, the first and second sides defining first and second medium carrying paths, respectively;

a post that is provided adjacent to the first side and that engages with a positioning part of the image forming apparatus, the post being a unit fulcrum about which the medium carrying unit rotates;

a handle member that has a handle post about which the handle member rotates, that is provided on the side surface, and that includes a handle side projection part that engages with a main body side projection part provided on the image forming apparatus when the medium carrying unit is installed, the handle side projection part being positioned between the main body side projection part and the second side; and a biasing part that is provided adjacent to the second side that pushes the medium carrying unit up causing the engagement between the handle side projection part and the main body side projection part to be automatically released when the medium carrying unit is removed from the image forming apparatus.

* * * * *